US005519469A

United States Patent [19]

Obata

[11] Patent Number: 5,519,469

[45] Date of Patent: May 21, 1996

[54] PRINTING PLATE USING A CHARGE CARRIER MEDIUM

[75] Inventor: Hiroyuki Obata, Tokyo, Japan

[73] Assignee: Dai Nippon Printing Co., Ltd., Tokyo, Japan

[21] Appl. No.: 375,392

[22] Filed: Jan. 18, 1995

Related U.S. Application Data

[62] Division of Ser. No. 101,962, Aug. 4, 1993, Pat. No. 5,414,496, which is a continuation of Ser. No. 700,164, May 20, 1991, abandoned.

[30] Foreign Application Priority Data

Sep. 21, 1989 [JP] Japan ..... 1-245430
Nov. 17, 1989 [JP] Japan ..... 1-299168

[51] Int. Cl.[6] ..... G03G 13/00; G03G 15/00

[52] U.S. Cl. ..... 355/210; 355/85; 430/44; 430/48

[58] Field of Search ..... 355/85, 210, 211; 430/44, 48, 49

[56] References Cited

U.S. PATENT DOCUMENTS 4,311,776 1/1982 Seino et al. ..... 430/120 X
4,565,759 1/1986 Tsutsui ..... 430/49 X
4,592,977 6/1986 Naganuma et al. ..... 430/49 X
4,985,322 1/1991 Azmai et al. ..... 430/49
5,161,233 11/1992 Matsuo et al. ..... 430/48 X
5,219,687 6/1993 Suzuki et al. ..... 430/49
5,298,947 3/1994 Aono et al. ..... 355/211

FOREIGN PATENT DOCUMENTS 63-221041 9/1988 Japan .

OTHER PUBLICATIONS

Patent Abstracts of Japan, vol. 10, No. 207 (P–162) Jul. 19, 1986, JP (A) 61–049895 (abstract).

Patent Abstracts of Japan, vol. 11, No. 324 (P–78) Oct. 22, 1987, JP (A) 62–109062 (abstract).

*Primary Examiner*—William J. Royer
*Attorney, Agent, or Firm*—Dellett and Walters

[57] ABSTRACT

A printing plate employs a charge carrier medium and includes a printing area constructed from a toner layer and charge carrier layer on an electrically conductive substrate.

1 Claim, 13 Drawing Sheets

FIG.14
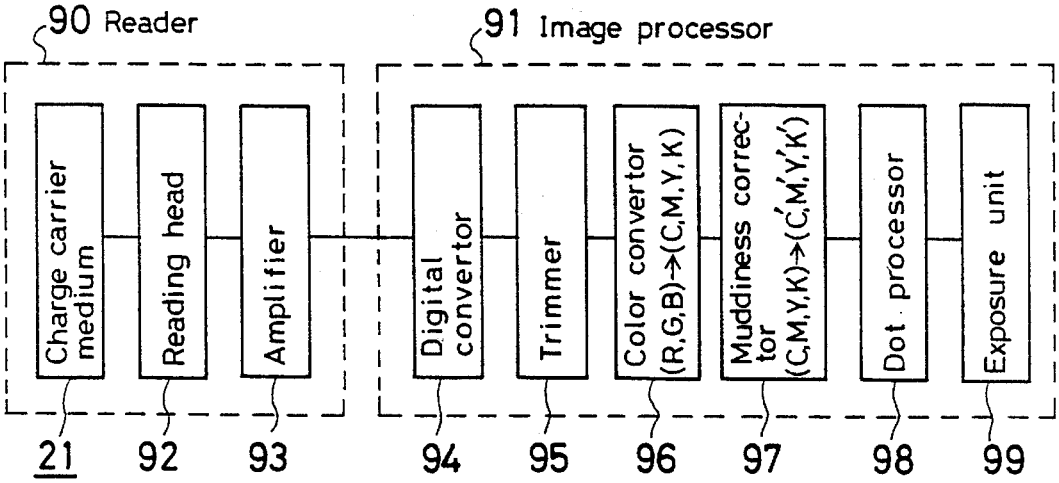
FIG.15(a)
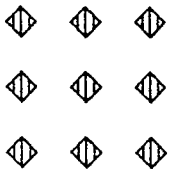
White
FIG.15(b)
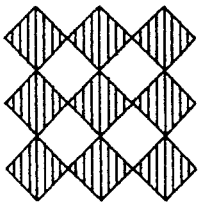
50 % dots
FIG.15(c)
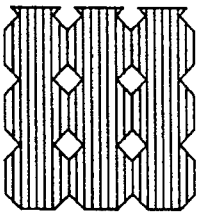
Black
FIG.16(a)
| | | | |
|---|---|---|---|
| 1 | 2 | 3 | 4 |
| 12 | 13 | 14 | 5 |
| 11 | 16 | 15 | 6 |
| 10 | 9 | 8 | 7 |
FIG.16(b)
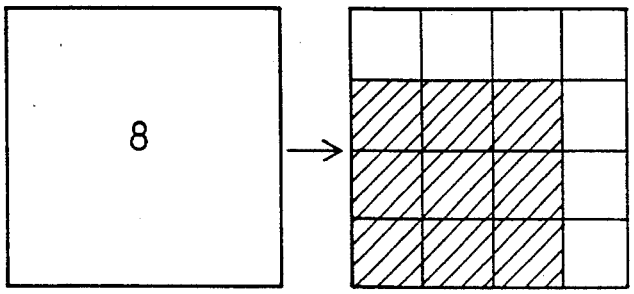

PRINTING PLATE USING A CHARGE CARRIER MEDIUM

This is a divisional of applications(s) Ser. No. 08/101,962 filed on Aug. 4, 1993 now U.S. Pat. No. 5,414,496, which is a continuation of Ser. No. 07/700,164 filed on May 20, 1991 abandoned, International Application PCT/JP90/001198 filed on Sep. 19, 1990 and which designated the U.S.

TECHNICAL FIELD

The present invention relates to a printing plate formed of charge carrier media, a process for making printing plates with charge carrier media and a page make-up system making use of charge carrier media, which is designed to make up pages by forming electrostatic latent images of the original images directly on given positions on printing plates formed of charge carrier media and at given magnifications.

BACKGROUND TECHNIQUE

Conventional methods for making printing plates so far known in the art include such systems as shown in FIGS. 17*a*–17*b*, 18 or 19*a*–19*c*.

The plate-making system shown in FIGS. 17*a*–17*b* is generally implemented as follows. In the first place, an aluminium plate 100 is provided, which has been polished by such polishing techniques as ball or brush polishing or "grained" in the jargon of the field, and a photosensitive resin layer 101 is formed on this aluminium plate 100 to form a printing substrate. Then, a plate-making film 102 is located in opposition to the resin layer 101, followed by pattern exposure (FIG. 17*a*) with ultraviolet rays 103, development and drying. In this way, a printing plate including a printing area formed by the resin layer 101 is produced, as shown in FIG. 17b. In this regard, it goes without saying that the film 102 has been subjected to page make-up, as with a film output from color scanners now referred to as layout scanners or page make-up scanners. This is also true of the description that follows. For color printing, it is a matter of course that printing plates must be prepared in association with four colors, i.e., yellow (Y), magenta (M), cyan (C) and black (K), respectively, and four such printing plates for Y, M, C and K may be prepared by using a film for each color instead of the film 102 of FIG. 17*a*.

Printing plates comprising grained aluminium plates and photosensitive layers formed thereon are generally called PS (presensitized) plates and are now commercially sold on the market. The PS plates are costly, but serve well due to the presence of the pre-coated photosensitive layers.

In print shops having photosensitive layer coating equipment, photosensitive layers have been actually coated on such grained aluminium plates as mentioned above. The thus prepared plates, called wipe-on plates, are less costly and more sensitive than the PS plates, but are inferior in serviceability to the PS plates due to some coating steps being needed. Serious limitation is imposed on the operation of the wipe-on plates as well, because they have such a short pot-life or the time span from their being coated to their use, that they must be exposed to light just after the formation of photosensitive layers thereon.

This is the reason that the PS plates are now virtually supplanting the wipe-on plates. As already mentioned, the PS plates can serve well, but the sensitivity of their photosensitive layers is not good enough, because they should stand up to long-term storage with the photosensitive layers coated on them. Generally speaking, the higher the sensitivity of the PS plates, the more they are reactive with respect to heat, thus often resulting in their fogging due to thermal reactions during storage. This makes it very difficult to increase the sensitivity of the PS plates.

Referring to FIG. 18, there is shown a printing substrate obtained by forming a photosensitive resin layer 106 on a grained aluminium plate 105 and forming thereon a layer 107 comprising a silver emulsion. This substrate may be processed into a printing plate by similar pattern exposure, development and drying as described in connection with FIGS. 17*a*–17*b*. This printing plate has been developed with a view of making up for the defect—low sensitivity—of the PS plates. More exactly, a silver emulsion layer is formed on a PS plate, which is in turn subjected to primary, low-energy exposure, while making use of the high sensitivity of the silver emulsion, thereby developing the silver emulsion. Then, the resulting blackened silver particle pattern is used as the original for all over uniform exposure (secondary exposure) and then development, thereby obtaining a printing plate. The objective is to take advantage of such low-energy exposure as laser-scanning exposure or projecting exposure.

Laser-scanning exposure of printing plates is a technique of vital importance especially when printing is to be carried out in printing plants located at remote places with information fed through communications lines, as is the case with preparing printing plates for "The Wall Street Journal". Projecting exposure, on the other hand, enables printing plates to be immediately prepared, if only reflection copies are available, and so can dispense with such time consuming steps of making film copies through process cameras as required conventionally.

These have a great merit of making low-energy exposure possible, but are costlier than the PS plates because expensive silver emulsions have been laminated thereon—to say nothing of it.

The plate-making process as shown in FIGS. 19*a*–19*a* resorts to one electrophotographic technique, wherein a photosensitive material 110 comprising a photoconductive material is first electrostatically charged by corona discharge in a uniform manner, then pattern exposed to light 112 having a given wavelength through a film 111 (FIG. 19*a*), and finally coated with a toner 113 (FIG. 19*b*), whereby the toner 113 is deposited onto only a portion of the material 110 that has not been exposed to the light 112. After that, this material is transferred and fixed onto a grained aluminium plate 114, thereby obtaining a printing plate including a printing area demarcated by the toner 113 (FIG. 19*c*).

Referring to FIGS. 20*a*–20*c*, there is shown a plate-making process relying upon another electrophotographic technique, wherein a photosensitive material 123 comprising a photoconductive material layer 122 and a grained aluminium plate 121 is first electrostatically charged by corona discharge in a uniform fashion, then pattern exposed to light 125 having a given wavelength through a film 124 (FIG. 20*a*) and finally coated with a toner 126, whereby the toner 126 is deposited onto a portion of the material 123 that has not been exposed to the light 125. After that, the toner 126 is fixed in place (FIG. 20*b*) and the exposed region of the photoconductive material layer 122 is etched out using the toner 126 as a resist, thereby exposing portions of the grained aluminium plate 121 to view (FIG. 20*c*). In this way, it is possible to obtain a printing plate in which the rest of the photoconductive material layer 122 and the toner 126 define a printing area and the exposed region of the grained aluminium plate 121 demarcates a non-image area.

As described above, various plate-making processes have been known in the art, but they have involved the following problems. That is to say, the plate-making process shown in FIGS. 17*a*–17*b* should use a highly sensitive type of resin, because it resorts to exposure to ultraviolet rays. In general, however, a class of material highly sensitive to ultraviolet rays is so poor in thermal stability that it is likely to suffer the so-called "thermal fogging". The highly sensitive type of resin, on the other hand, has a molecular weight so low that it offers a problem in connection with the resistance to printing required, i.e., the mechanical strength that printing plates are required to have. Thus, considerable difficulty will be encountered in finding a type of material that is satisfactory in terms of both sensitivity and resistance to printing.

By contrast, the printing substrate shown in FIG. 18 can be made more sensitive by the use of silver emulsions and can use conventional types of resin for the resin layer 106. However, this has a serious defect of being costly.

In the process shown in FIGS. 19*a*–19*c*, it is essentially required that the transfer of the toner image formed on the photosensitive material 110 onto the aluminium plate 114 occur at a relative speed of zero. When this relative speed deviates from zero, misalignment or pattern distortion occurs during printing. This is even so especially when printing plates of a large area are used. Also, the toner is likely to fall into disarray, triggering a serious drop of resolving power.

The process shown in FIGS. 20*a*–20*c*, without recourse to toner transfer, is more unlikely to cause the toner image to be disarrayed, as compared with the process shown in FIGS. 19*a*–19*c*. Since the photoconductive material layer forms part of the printing area, however, it must be satisfactory in terms of both sensitivity and mechanical strength.

Generally, photoconductive material layers are obtained by dispersing such photoconductive pigments as zinc oxide in polymeric materials. In order to achieve sufficient sensitivity, however, they should contain zinc oxide in so large an amount, say 80% in weight ratio, that they become fragile and lack in resistance to printing.

In order to solve these problems, it has been proposed to use a process wherein the surface, exposed to light, of the photoconductive material layer 122 is made hydrophilic as,by phosphoric acid without etching, while the toner is fixed on such a photosensitive plate 123 as shown in FIG. 2O*b*, whereby the printing area is defined by the toner region and the non-image area is demarcated by the exposed region of the photoconductive material layer thus made hydrophilic. According to this process, however, what has been made hydrophilic is only the photoconductive pigment, e.g. zinc oxide. This, combined with the fact that the polymeric material serves as a binder, renders it impossible to afford sufficient hydrophilic nature to the photoconductive material layer, thus often causing such an accident as scumming. Once ink has been deposited onto the non-image area, there is no choice but to replace the plate with a new one.

With the electrophotographic systems used so far and described above, if it is intended to use the photoconductive material layer as a printing area, then photoconductivity and the mechanical strength required for the printing area are incompatible with each other. On the contrary, if it is intended to use the photoconductive material layer as a non-image area, then the hydrophilic nature required for the non-image area is far from satisfactory. This may be solved by transferring the toner on other grained aluminium without being fixed on the photosensitive material. However, there arises another problem that the toner image falls into disarray, rendering it impossible to maintain resolving power.

In the foregoing, the conventional printing plates, conventional processes for making printing plates and problems in association therewith have been described. In the description that follows, reference will be made to conventional page make-up systems.

In the prior art page make-up systems, originals, if limited in number, are individually applied on the input drums of associated color scanners, and are then separated into four colors C, M, Y and K under the preset color separation conditions and at the prescribed magnification, followed by electronic page make-up operation with page makeup equipment. When a large number of originals are used, on the other hand, the duplication of the color originals is made at an intermediate duplication magnification found by: Intermediate dublication magnification=(Final magnification)/(scanning magnification). This enables the originals to be separated into colors by a single cycle of scanning at a plurality of different magnifications. Thus, the scanning magnifications can be standarized by making duplicates of the color originals at an intermediate step. With these duplicates, the originals having different final magnifications are mounted on the same scanning drum, thereby pushing on effective color separation.

In an effort to rationalize page make-up steps, some intermediate duplicates of the originals are mounted on the scanner drum, while taking the final magnification into account.

These procedures are now called the duplication assembly.

However, the former method is very troublesome and time consuming, since it is required to preset the color scanner's separation conditions for each of the individual originals in terms of input magnification and color separation. Such presetting of color separation conditions is largely dependent upon the experience of operators and is very exacting. Taken altogether, this method has failed to boost the efficiency of operation of costly color scanners. In addition, computer operation is required for page-making-up large volumes of data input for each original according to layout instructions, and this is a time consuming process. As a result, there have been drops in the efficiency of operation of not only color scanners but computers for page-making-up as well.

A major problem with the latter "duplication assembly" is that it takes much time and expense to make duplicates, although the presetting of color scanner's separation conditions is achievable in a single operation.

Other incidental problems are that duplication makes images degrade in quality, e.g. renders image quality hard in tone; a plurality of originals undergo color separation under the same setting-up conditions—because the cycle of scanning is one, so that color separation may not always occur under the optimum setting-up conditions for the individual originals; and for similar reasons, this procedure cannot be used for originals differing largely in their setting-up conditions.

Having been accomplished against such a background, the present invention seeks to provide a printing plate that is well resistant to printing but dispenses with any transfer process by forming a toner image directly on a charge carrier medium and a method for making it. Another object of this invention is to provide a page make-up system using a charge carrier medium, wherein page-making-up is performed directly on a charge carrier medium by exposure with the application of voltage, thereby boosting the efficiency of page make-up operation.

DISCLOSURE OF THE INVENTION

According to this invention, the above-described first object is attained by the provision of a printing plate using a charge carrier medium, characterized by including a printing area on an electrically conductive substrate, said printing area being constructed from a charge carrier layer and a toner layer.

The printing plate using a charge carrier medium according to this invention, which includes on an electrically conductive substrate a printing area defined by a charge carrier layer and a toner layer, has the following effects.

The charge carrier medium, which is not required to have photosensitivity or photoconductivity in itself and serves its own purpose if only it retains charges within a short time to development, may be formed of any one excelling in resistance to printing and resolution, chosen among a wide class of materials. In general, photosensitive- or photoconductivity-free materials may be given excellent resistance to printing, since their mechanical strength may be increased.

In addition, the non-image area may be made of a highly hydrophilic base metal material used with generally available planographic printing plates. This contributes to improvements in workability, since sufficient water retention is achieved with easy control of dampening water during printing, etc.

Since the printing area is so covered with a toner layer that its lipophilic nature is on a sufficient level, its ink receptivity at the initiation time of printing is satisfactory, thus enabling high-quality prints to be obtained from just after the beginning of printing. In addition, even when the toner area wears away by continued printing, high printability will still be obtained without weakening because the charge carrier layer underlies the toner layer.

The method for making printing plates using charge carrier media according to this invention is characterized by including:

- a first step of applying voltage between a charge carrier medium comprising an electrically conductive substrate and a charge carrier layer and a photosensitive material to exposing said photosensitive material to a given pattern, thereby forming an electrostatic latent image having a given pattern on said charge carrier layer;
- a second step of toner-developing and fixing said electrostatic latent image on said charge carrier layer, obtained at said first step, and
- a third step of removing all portions of said charge carrier layer but the toner image obtained at said second step.

With such a production process wherein the toner image is formed directly on the charge carrier layer by exposure with the application of voltage, it is unnecessary to transfer the toner image, as carried out in the prior art, and it is thus possible to form a printing area having high resolving power.

During exposure, photosensitivity is provided by the photosensitive material while resistance to printing is provided by the charge carrier medium. Thus, the functions of photosensitivity and resistance to printing can be separated from each other, enabling the material used to be selected from a wide range of materials.

The exposure system with the application of voltage is so highly sensitive that it can be spectrally sensitive to the wavelength of laser light by selecting the type of photosensitive material. Thus, not only low-energy exposure but also scanning exposure using laser light is possible. For similar reasons, this system has an additional advantage of being able to use inexpensive light sources such as tungsten lamps.

In addition, a projection type of exposure can be carried out with this system, making it possible to project an original plate of small size on an enlarged scale and reduce storage space.

The page make-up system using a charge carrier medium according to this invention is characterized in that:

- a photosensitive material is located in opposition to a charge carrier medium; an original image is exposed to light and projected through said photosensitive material on a given position at a given magnification and in a given direction, while a given voltage is applied between said photosensitive material and said charge carrier medium, whereby said image of the original is formed on said charge carrier medium in the form of an electrostatic latent image; and charges of said electrostatic latent image are read by a read sensor.

With such a page make-up system wherein the image of an original is projected directly on the prescribed position at the prescribed magnification by the projecting exposure, all processings inclusive of trimming can be carried out electrically. Therefore, it is unnecessary to preset the color scanner's color separation conditions for each original, as required in the conventional page make-up systems. Nor is the "duplication assembly" needed. In addition, page make-up work can be expedited to boost the efficiency of computer operation, resulting in the steps of making printing plates being efficiently facilitated.

BRIEF DESCRIPTION OF THE DRAWINGS

FIG. 14 is a view showing an example of the steps of processing image data, FIG. 15*a*–15*c* are views for illustrating dot processing, FIG. 16*a*–16*c* are views for illustrating how to form dots.

BEST MODE FOR CARRYING OUT THE INVENTION

Figure 1:
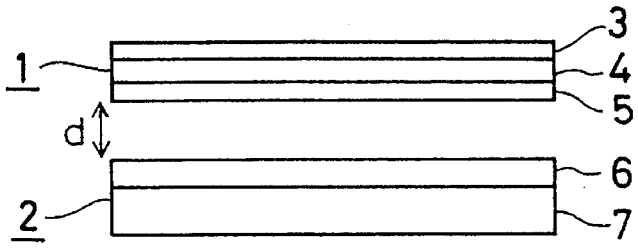
FIGS. 1*a*–1*g* are sectional views showing one embodiment of the method for making printing plates using charge carrier media according to this invention.
Figure 1:
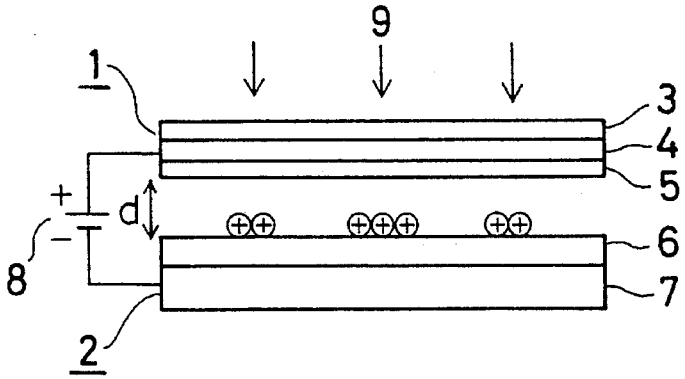
Figure 1:
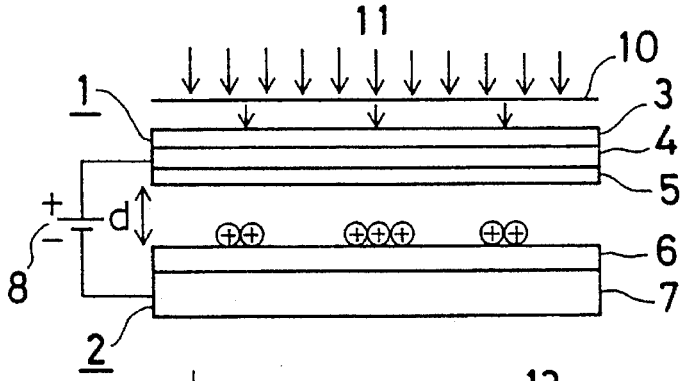
Figure 1:
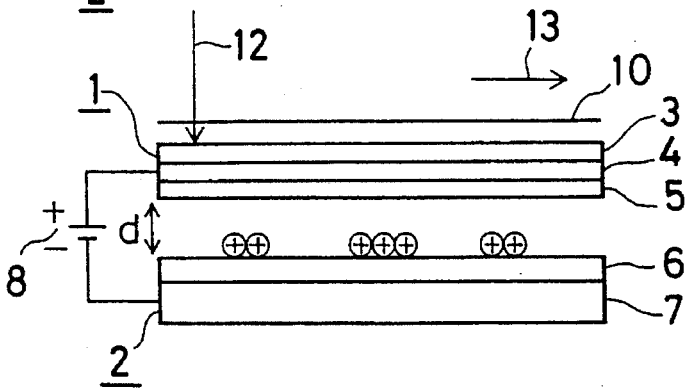
Figure 1:
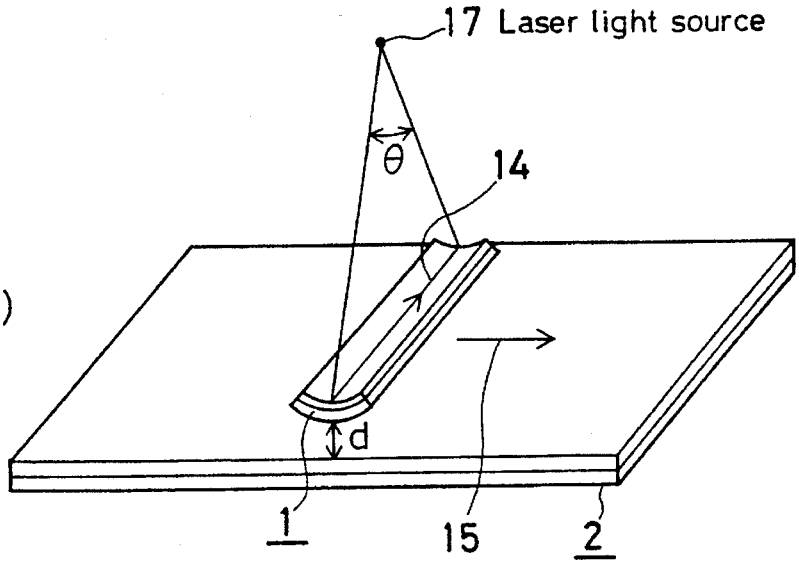
Figure 1:
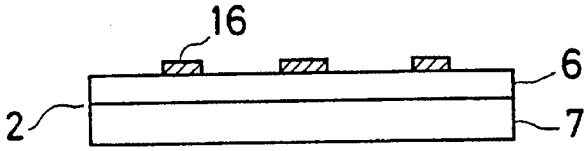
Figure 1:
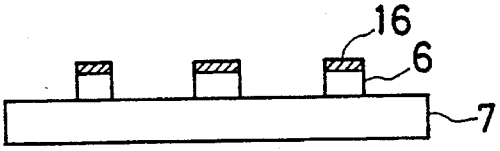

Reference will now be made to the printing plate using a charge carrier medium and how to make it.

In FIGS. 1*a*–1*g*, reference numeral 1 stands for a photosensitive material, 2 a charge carrier medium, 3 a member for supporting the photosensitive material, 4 an electrode incorporated in the photosensitive material, 5 a photoconductive layer, 6 a charge carrier layer, 7 an electrically conductive substrate, and 8 a power source.

With the method for making printing plates using a charge carrier medium according to this invention which relies upon an image recording system by exposure with the application of voltage, an electrostatic latent image is first formed on the charge carrier layer 6 by exposure with the application of voltage. Referring more illustratively to FIGS. 1*a*–1*g*, the photosensitive material 1 is first prepared by forming the electrode 4 and the layer 5, both in film forms, on the support 3 in that order. As shown in FIG. 1(*a*), the photoconductive layer 5 of the material 1 is located in opposition to the charge carrier layer 6 of the charge carrier medium 2 with a given distance of d between them, said medium 2 being prepared by providing on the conductive substrate 7 said layer 6 in a film form. Then, as shown in FIG. 1*b* by way of example, light 9 of a given wavelength is permitted to be incident upon the photosensitive material 1 for exposure, while keeping the electrode 4 positive and the substrate 7 negative by connection to the power source 8. In the dark, no change will occur across the electrode because of the photoconductive layer 5 being a high resistance body. However, as the light strikes upon the photosensitive material 1, a portion of the photoconductive layer 5 on which the light is incident is made so electrically conductive that internally generated photocarriers can be accumulated on the charge carrier medium 2 in the form of image charges. This in turn enables a desired electrostatic latent image to be formed on the charge carrier layer 6 of the medium 2, as illustrated in FIG. 1(*b*).

It is understood that exposure may be carried out in a pattern exposure fashion wherein, as illustrated in FIG. 1(*c*), given light 11 is allowed to be incident all over the surface of a film 10 having a predetermined pattern, which is spaced away from the support 3 at a suitable interval or brought in close contact with it. Alternatively, exposure may be performed by scanning the film 10 with laser light 12 in a direction shown by an arrow 13, as shown in FIG. 1(*d*). As a matter of course, the second type of exposure may also be implemented without recourse to such a film original 10 as shown in FIG. 1(*d*), i.e., by using the laser light 12 which has been modulated by image data made up by means of a color scanner. For the so-called "expeditious printing" designed to make prints of relatively limited size, exposure may be done while the photosensitive material 1, identical in size with the charge carrier medium 2, is located in opposition to that medium 2, as illustrated in FIGS. 1(*b*) to 1(*d*). However, when difficulty is involved in holding the photosensitive material 1 and the charge carrier medium 2 with the predetermined distance d between them, such as when it is intended to obtain prints of a large area, the material 1 is formed into a virtually semi-cylindrical shape, as shown in FIG. 1(*e*) for the purpose of illustration alone. Then, the material 1 may be scanned with light from a laser light source 17 along a line, shown at 14, and only over an angular range defined by θ—main scanning, while it is moved and sub-scanned in a direction shown by an arrow 15 or in the opposite direction while keeping a predetermined distance d between it and the charge carrier medium 2.

Following the formation of the thus patterned electrostatic latent image on the charge carrier layer 6, the charge carrier medium 2 is disconnected from the power source 8. Then, toner is coated on the charge carrier layer 6 for development, followed by toner fixation by heating. Thus, the electrostatic latent image formed on the charge carrier layer 6 takes shape as a toner image 16, as depicted in FIG. 1(*f*). Subsequently, a toner-free region is etched out of the charge carrier layer 6 by suitable means, using the toner image 16 as a mask, whereby a printing area-bearing, printing plate constituted by the toner 16 and the charge carrier layer 6 can be obtained on the electrically conductive substrate 7.

While one embodiment of how to make printing plates with the use of charge carrier media has been described, reference will now be made to the above-mentioned materials and the conditions for preparing them.

The photosensitive material-supporting member 3 may be made of transparent materials through which active light for the photoconductive layer 5 is transmissible, such as various kinds of transparent glass, e.g. usual glass, quartz glass, non-alkali glass and Pyrex®; transparent thermoplastic resins, e.g. acrylic resin, polycarbonate, polyester, polystyrene, polyethylene and polypropylene; and transparent heat-curable resins, e.g. epoxy resin and polyimide resin. The support 3 may be 10 μm to 10 mm in thickness, and may have a thickness of 0.3 mm to 10 mm, especially when it is formed of a glass, acrylic or polycarbonate sheet. Also, when the support is formed of such a film as a polyester or polyimide film, it may have a thickness lying in the range of 10 to 500 μm.

The support 3 used may be in flat or other forms. As shown in FIG. 1(*e*), it may be formed into a virtually semi-cylindrical shape. In this case, the semicircle may have a radius lying in the range of 1 to 50 mm. For instance, sheets of a material of 1 mm in thickness and having relatively high rigidity, such as glass or resin, e.g., acrylic or polycarbonate resin, should have preferably been pro-processed into a desired semi-cylindrical shape, although varying with the rigidity of the support and photoconductive materials or the semicircle's radius. Such films as polyester films may be transformed into a cylindrical shape to form an electrode and a photoconductive layer. Alternatively, they may be cut out or otherwise shaped in a semi-cylindrical form of suitable size, after the formation of a flat or coiled type of electrode and photoconductive layer.

Of the photoconductive layers to be described later, those composed mainly of organic materials in particular are generally of such flexibility, so that when used in combination with flexible supports formed of, e.g. polyester, they can be easily formed into a semi-cylindrical shape after having been provided with a flat- or coiled-form of electrode and photoconductive layer.

Inorganic photosensitive materials, such as materials typified by amorphous silicon and selenium, are usually formed into films by CVD, vacuum deposition or other techniques in the absence of any binder. Because photoconductive layers are less flexible, however, their film thickness should preferably be reduced to 3 μm or below, when they are transformed into a semi-cylindrical shape after the formation of a flat or coiled type of electrode and photoconductive layer on flexible supports such as polyimide or polyester film supports.

Some inorganic photosensitive materials including cadmium sulfide or zinc oxide powders have been mixed with organic binders, coated and formed into photosensitive layers. Their flexibility lies halfway between those of the above-mentioned organic photosensitive materials and amorphous silicon or selenium photosensitive materials. Thus, they can be processed into a semi-cylindrical shape, if it is 2 mm or more in radius, with no practical difficulty. It is then unnecessary to make photosensitive layers thin.

The electrode 4, for instance, may be an electrically conductive film made of such materials as tetracyanoquinodimethane and polyacetylene, a transparent electrode formed of such metal oxides as ITO, ZnO and $SnO_2$, or a transparent electrode formed of thin films of such metals as Au, Pt and Pd, all being about 100 to 1,000 angstroms in thickness and 10 to 1,000 Ω/□ in plane resistance value.

The electrode 4 may be prepared in conventional manners, e.g., by plating, sputtering, vacuum deposition, CVD and coating followed by heat treatments, and may be transparent to active light for the photoconductive layer 5.

Upon irradiation with light, the photoconductive layer 5 generates photocarriers (electrons, positive holes) from the irradiated site, which can migrate widthwise there-through. The layer 5 is more effective especially in the presence of an electric field. The layer 5 may be formed of an inorganic photoconductive material, an organic photoconductive material, a composite inorganic/organic type of material, and so on.

Such photoconductive materials and how to form photoconductive layers will now be explained in greater detail.

(A) Inorganic Photosensitive Materials (Photoconductors)

The inorganic photosensitive materials used may include amorphous silicon, amorphous selenium, cadmium sulfide, zinc oxide and the like.

(a) Amorphous Silicon Type of Photosensitive Material

The amorphous silicon type of photosensitive material may include:

(1) hydrogenated amorphous silicon (a-Si:H), and (2) fluorinated amorphous silicon (a-Si:F).

This type of photosensitive material may further include:

(3) hydrogenated amorphous silicon carbide (a-SiC:H), and (4) hydrogenated amorphous silicon nitride (a-SIN:H) which have in their composition carbon C and nitrogen N to control the electrical resistance and spectral sensitivity of photoconductive layers.

These materials may not have been doped with impurities; have been converted into P types (hole transfer types) by doping with such elements as B, Al, Ga, In and Ti; and have been converted into N types (electron transfer types) by doping with such elements as P, Ag, Sb and Bi.

In order to form photosensitive layers, silane and impurity gases may be introduced with hydrogen gas, etc. into a low-vacuum atmosphere ($10^{-2}$ to 1 Torr) to deposit them on electrode substrates heated or not heated by glow discharge into films, or may be formed on electrode substrates simply heated through thermochemical reactions. Alternatively, the starting solid feed may be formed into films by vapor deposition or sputtering. The obtained films may be used in the form of a single or laminated films. The films may have a thickness of 1 to 50 μm.

The electrode 4 may additionally be provided on its surface with a charge blocking layer which, when not exposed to light, serves to prevent charges from being injected, as the photoconductive layer were exposed to light from the electrode 4. For that purpose, an insulating layer or layers such as s-SiN, a-SiC, $SiO_2$ and $Al_2O_3$ layers, may be formed on one or both of the electrode substrate and the uppermost (surface) layer of the photosensitive material by glow discharge, vapor deposition, sputtering or other suitable means. The insulating layer is required to have a thickness of at most 1,000 angstroms, since too increased a thickness prevents an electric current from passing through it, when exposed to light. In view of the ease with which the insulating layer is prepared, etc. it may preferably lie in the thickness range of about 400 to 500 angstrom.

As the charge blocking layer, the electrode substrate is preferably provided a charge transport layer capable of transporting charges of polarity opposite to that of the electrode substrate, making use of rectifying effects. If the electrode is negative, then a hole transport layer may be provided, and if the electrode is positive, then an electron transport layer may be provided. For instance, a-Si:H($n^+$) wherein Si is doped with boron has hole transport properties so increased that it produces rectifying effects, and so functions as a negative charge blocking layer. (b) Amorphous Selenium Type of Photosensitive Materials The amorphous selenium type of photosensitive material includes (i) amorphous selenium (a-Se), (ii) amorphous selenium tellurium (a-Se-Te), (iii) amorphous arsenic selenium (a-$As_2Se_3$), (iv) amorphous arsenic selenium+Te (a-As-Se-Te) or the like.

This type of photosensitive material may be prepared by vapor deposition or sputtering, and an $SiO_2$, $Al_2O_3$, SiC or SiN layer may be formed on an electrode substrate as the charge blocking layer by vapor deposition, sputtering, glow discharge or other suitable means. Alternatively, the above-described substances (i) to (iv) may be used in combination and formed into a laminated type of photosensitive material. This type of photosensitive layer may be similar in thickness to the amorphous silicon type of photosensitive material.

(c) Cadmium Sulfide (CdS)

This type of photosensitive material may be prepared by coating, vapor deposition or sputtering. For vapor deposition, solid particles of CdS may be placed on a tungsten board and vapor-deposited thereon by resistance heating or EB (electron beams). For sputtering, CdS targets may be used for deposition on substrates in argon plasma. In this case, CdS is usually deposited in an amorphous state, but it may be possible to obtain crystalline, oriented films (oriented in the thickness direction) by selecting the sputtering conditions. =For coating, CdS particles (having a particle size of 0.1 to 1 μm) dispersed in binders with the addition of solvents may be coated on substrates.

As the binders, use may then be made of various types of resin, e.g. silicone resin, styrene-butadiene copolymer resin, epoxy resin, acrylic resin, saturated or unsaturated polyester resin, polycarbonate resin, polyvinyl acetal resin, phenolic resin, polymethyl methacrylate (PMMA) resin, melamine resin and polyimide resin.

The amount of CdS to be added may lie in the binder to CdS range of 1:3 to 1:1 in weight ratio.

This CdS type of photosensitive material may be coated on semi-cylindrical substrates by not only dip or cast coating but also blade coating making use of a blade located with a suitable gap between it and the substrates.

The resulting films may have a thickness lying in the range of 3 to 100 μm.

(d) Zinc Oxide (ZnO)

This type of photosensitive material may be prepared by coating or CVD. For coating, ZnO particles (having a particle size of 0.1 to 1 μm) dispersed in binders with the addition of solvents may be coated on substrates.

As the binders, use may then be made of various types of resin, e.g. silicone resin, styrene-butadiene copolymer resin, epoxy resin, acrylic resin, saturated or unsaturated polyester resin, polycarbonate resin, polyvinyl acetal resin, phenolic resin, polymethyl methacrylate (PMMA) resin, melamine resin and polyimide resin.

The amount of ZnO to be added may lie in the binder to ZnO range of 1:3 to 1:10 in weight ratio.

The resulting films may have a thickness lying in the range of 3 to 100 μm.

This type of photosensitive material may be coated on semi-cylindrical substrates in similar manners as used with the cadmium sulfide type of photosensitive material. For CVD, such organic metals as diethyl zinc and dimethyl zinc are mixed with oxygen gas in a low-vacuum atmosphere ($10^{-2}$ to 1 Torr), and the resulting mixture is then subjected to chemical reactions on electrode substrates heated (to 150° to 400° C.), whereby it is deposited thereon in the form of a zinc oxide film, which is again oriented in the thickness direction.

(B) Organic Photosensitive Materials

The organic photosensitive material is broken down into single-layer and function-separated types.

(a) Single Layer Type of Photosensitive Material

The single layer type of photosensitive material comprises a mixture of a charge generating substance with a charge transporting substance.

Charge Generating Substance System

Belonging to this system are a class of substances likely to absorb light to generate charges. Usable to this end, for instance, are azo pigments, bisazo pigments, trisazo pigments, phthalocyanine pigments, perylene pigments, pyrylium dyes, cyanine dyes and methine dyes.

Charge Transporting Substance System

Belonging to this system are a class of substances capable of well transporting ionized charges. Usable to this end, for instance, are hydrazones, pyrazolines, polyvinyl carbazoles, carbazoles, stilbenes, anthracenes, naphthalenes, tridiphenylmethanes, azines, amines and aromatic amines.

Charge-transfer complexes may also be formed from the charge-generating and -transporting substances.

Usually, photosensitive materials have their photosensitive characteristics determined by the light absorption properties of the charge-generating substances. However, the complexes obtained by mixing together the charge-generating and -transporting substance have their light absorption properties varied. For instance, polyvinyl carbazole (PVK) is only sensitive in the ultraviolet region and trinitrofluorenone (TNF) is only sensitive in the vicinity of a 400-nm wavelength zone, but PVK-TNF complexes are sensitive even to wavelength regions of up to 650 nm.

Such a single layer type of photosensitive films may preferably have a thickness of 10 to 50 μm.

(b) Function-Separated Type of Photosensitive Material

The charge-generating substances are likely to absorb light but have the property of trapping charges, whereas the charge-transporting substances have superior charge-transporting characteristics but are inferior in terms of light absorption. For that reason, both the substances are separated from each other to make much use of their respective properties. Thus, charge-generating and -transporting layers are laminated together.

Charge Generating Layer

The substances forming the charge generating layers, for instance, may include compounds based on azo, bisazo, trisazo, phthalocyanine, acid xanthene dye, cyanine, styryl pigment, pyrylium, perylene, methine, a-Se, a-Si, azulenium salt and s qualenium systems.

Charge Transporting Layer

The substances forming the charge transporting layers, for instance, include compounds based on hydrazone, pyrazoline, PVK, carbazole, oxazole, triazole, aromatic amine, amine, triphenylmethane and polycyclic aromatic systems.

In order to make the function-separated type of photosensitive material, the charge generating substance is first dissolved or dispersed with solvents in binders, and the resulting coating solution is then coated on electrodes by means of rotary coating, roll coating, wire bar coating, blade coating, spray coating, dip coating or other suitable technique. After that, the charge transporting substance is dissolved with solvents in binders, and the resulting coating solution is then likewise coated on the charge generating layer. The resulting charge generating layer may have a thickness of 0.1 to 5 μm, while the charge transporting layer may be 2 to 50 μm in thickness.

Binders used for both the single-layer and function-separated types of photosensitive materials, for instance, include various forms of resin, e.g. silicone resin, styrene-butadiene copolymer resin, epoxy resin, acrylic resin, saturated or unsaturated polyester resin, polycarbonate resin, polyvinyl acetal resin, phenolic resin, polymethyl methacrylate (PMMA) resin, melamine resin and polyimide resin. For facilitated deposition, the binder should be used in an amount of 0.1 to 10 parts per part of each of the charge-generating and -transporting layers. Coating may be achieved by not only the above-mentioned wet coating processes but dry coating processes as well, e.g. vapor deposition, sputtering and CVD.

The function-separated type of photosensitive material is not critical as to which of the charge-generating or -transporting layer is to be first laminated on a transparent electrode. Because exposure occurs from the side of the electrode, it is preferable that when use is made of a charge transporting layer less transparent to active light used for exposure, the charge generating layer be first formed on the electrode.

The charge blocking layer will now be explained in greater detail.

The charge blocking layer may be provided on at least one or both sides of the photoconductive layer 5 so as to prevent a dark current (the injection of charges from the electrode) from passing through it, i.e., a phenomenon that even when not actually exposed to light, charges migrate through the photoconductive layer, as if it were exposed to light.

The charge blocking layer is of two types, one making use of an insulating thin film and the other relying upon rectifying effects. When the first type of layer making use of an insulating thin film is used, mere application of voltage does not allow currents to pass through the photoconductive layer or reach the surface of the resin layer due to its presence. As light is incident upon the charge blocking layer, however, a high electric field is applied to its site exposed to light due to the presence of one (electron or hole) of the charge generated in the photoconductive layer, so that currents can pass through the photoconductive layer by way of the charge blocking layer. Such a charge blocking layer may be formed of an inorganic insulating film, an insulating, organic polymeric film or an insulating monomolecular film, which may be used alone or laminated together for use. The inorganic insulating film, for instance, may be obtained by $As_2O_3$, $B_2O_3$, $Bi_2O_3$, CdS, CaO, $CeO_2$, $Cr_2O_3$, CoO, $GeO_2$, $HfO_2$, $Fe_2O_3$, $La_2O_3$, MgO, $MnO_2$, $Nd_2O_3$, $Nb_2O_5$, PbO, $Sb_2O_3$, $SiO_2$, $SeO_2$, $Ta_2O_5$, $TiO_2$, $WO_3$, $V_2O_5$, $Y_2O_5$, $Y_2O_3$, $ZrO_2$, $BaTiO_3$, $Al_2O_3$, $Bi_2TiO_5$, CaO—SrO, CaO—$Y_2O_3$, Cr—SiO, $LiTaO_3$, $PbTiO_3$, $PbZrO_3$, $ZrO_2$—Co, $ZrO_2$—$SiO_2$, AlN, BN, NbN, $Si_3N_4$, TaN, TiN, VN, ZrN, SiC, TiC, WC and $Al_4C_3$ by glow discharge, vapor deposition, sputtering or other suitable techniques. It is noted that the thickness of this layer may be determined for each material, while taking into consideration the insulating properties for preventing the injection of charges. Usually, however, it may be selected from the range of 0.01 to 10 μm, preferably 0.05 to 1 μm.

For the other type of charge blocking layer that relies upon rectifying effects, there is provided a charge transporting layer capable of transporting charges through such effects and having polarity opposite to that of an associated electrode. Thus, such a charge blocking layer may be formed of an inorganic photoconductive layer, an organic photoconductive layer or a composite inorganic/organic type of photoconductive layer, and may have a film thickness of about 0.1 to 10 μm. More illustratively, when the electrode is negative, use may be made of an amorphous silicon photoconductive layer doped with B, Al, Ga, In, etc., or an organic photoconductive layer formed by dispersing in resin amorphous selenium or such a compound as oxadiazole, pyrazoline, polyvinyl carbazole, stilbene, anthracene, naphthalene, tridiphenylmethane, triphenylethane, azine, amine or aromatic amine. When the electrode is positive, use may be made of an amorphous silicon photoconductive layer doped with P, N, As, Sb, Bi, etc., or a ZnO photoconductive layer obtained by glow discharge, vapor deposition, CVD, coating or other suitable techniques.

Usually, the distance d may be about 10 μm. However, d may be zero; the photoconductive layer 5 may be in close contact with the charge carrier layer 6.

Figure 2:
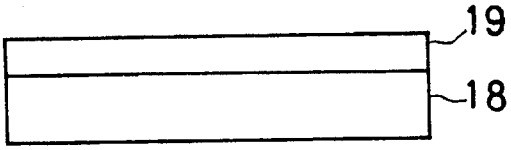
FIG. 2 is a sectional view showing one embodiment of the construction of the electrically conductive substrate.

The electrically conductive substrate 7 must function as an electrode during voltage application and exposure, and should be made hydrophilic at least on its surface for use as a planographic printing plate. Usable to this end is an about 0.3-mm thick, grained aluminium plate. Thus, to use a grained aluminium plate as the electrically conductive substrate 7 is found to be particularly advantageous for large-area printing. As shown in FIG. 2, however, a 1000-angstrom to 1-μm thick, aluminium film layer 19 formed on an insulating substrate 18 formed of glass, etc. as by vapor deposition may be used for obtaining small-area prints, nearly the size of postcards. Zinc may be used in place of aluminium.

Essentially required for the charge carrier layer 6 is that not only is it capable of retaining charges, but it is removable by suitable etching and needs to be hydrophillic enough to form a printing area and to have resistance to printing or, in a better word, mechanical strength. For instance, such materials as will be described later may be used. It is understood that the charge carrier layer 6 may have a thickness of about 2 to 10 μm.

Recording information on or in it in the form of an electrostatic charge distribution, the charge carrier layer 6 needs to have enough insulating properties to limit migration of charges, say, a specific resistance that is at least as high as $10^{14}\Omega$/cm. Such a charge carrier layer 6 may be prepared by dissolving various types of rubber or resin in solvents, followed by coating, dipping, vapor deposition or sputtering.

The types of resin and rubber used in this invention, for instance, may include polyethylene, polypropylene, vinylic resin, styrol resin, acrylic resin, nylon 66, nylon 6, polycarbonate, acetal homopolymer, fluoroplastic, cellulose resin, phenolic resin, urea resin, polyester resin, epoxy resin, flexible epoxy resin, melamine resin, silicon resin, phenoxy resin, aromatic polyimide, PPO and poly-sulfone; and polyisoprene, polybutadiene, polychloroprene, polar nitrile, polyacrylic rubber, chlorosulfonated poly-ethylene, ethylene/propylene rubber, fluororubber, silicone rubber, polysulfide-based synthetic rubber and urethane rubber, all being used alone or in admixture.

Among other materials usable for the charge carrier layer 6, there are cellulose acetate succinate half-ester and polyvinyl pyridine (as an elutant for them an aqueous solution of dilute alkali may be usable; the bracketed compounds shall hereinafter refer to elutants); partially saponified polyvinyl acetate (water); partially saponified polyvinyl acetate/ethylene oxide adduct and polyvinyl pyrrolidone (water): polyurethane polyene (a dilute aqueous alkaline solution); an unsaturated type of polyester using a polyethylene glycol wherein n is at least 6, such as a polyethylene glycol/adipic acid/ fumaric acid polycondensate or an unsaturated type of polyester modified by such diisocyanatos as toluene diisocynato and phenylene diisocyanato (an aqueous solution of dilute alkali); an alcohol soluble type of polyamide such as an -caprolactam-hexamethylenediamine/adipate polycondensate (alcohol); a cation type of water soluble polyamide such as an -caprolactam-N,N'-bis(β-aminopropyl)piperazine/adipic acid polycondensate (water); an anion type of water soluble polyamide such as polycondensate of polyamide-hexamethylenediamine/terephthalate with sodium isophthalate sulfonate (water); polyether ester amide such as such as a double bond-terminated polycondensate obtained by the reaction of polyamide with polyethylene glycol, then adipic acid and finally glycidyl methacrylate (water); thermoplastic elastomers such as styrene/isoprene/styrene block copolymer, styrene/butadiene/styrene block polymer, nitrile rubber and syn-1,2-polybutadiene (halogenated hydrocarbons); ternary block polymers such as acrylonitrile/butadiene/acrylic acid copolymers (an aqueous solution of sodium carbonate); block polymers such as styrene/isoprene/styrene block polymers (halogenated hydrocarbons); solvent soluble fluoroplastic—"CYTOP" made by Asahi Glass Co., Ltd —(an exclusive solvent available for it); polycarbonate resin (1,1,2-trichloroethane), silicone varnish—e.g. "TSR144" made by Toshiba Silicone Co., Ltd.—(xylene); and so on. After elution, the product may further be baked at about 150° C. for about 30 minutes so as to achieve a further improvement in its resistance to printing.

The power source 8 may be operable at a d.c. voltage of 500 to 1,500 volts. For instance, if plus voltage is applied to the electrode 4, as shown in FIG. **1*b*–1*d*** then a positively charged pattern is formed on the charge carrier layer. This pattern may in turn be developed with negatively charged toner particles.

As the exposure light sources, use may be made of laser light and ultraviolet rays. Use may also be made of visible light emanating from tungsten, halogen or other lamps. For instance, when an a-Se photosensitive material with a 30-μm thick a-Se laminated thereon is used on a 5,000-angstrom thick, a-SeTe charge generating layer, exposure may be carried out at about 50 luxes for 0.1 second, using tungsten lamp light having a color temperature of about 4,000° K.

The wet and dry types of toners may both be used in this invention. The dry type of toner is so relatively large, say 10 to 30 μm, in particle size that it is inferior in terms of resolution, but the wet type of toner gives sufficient resolution because its particle size is small, say, about 0.1 to 3 μm.

Toner fixation may be effected at such a temperature as set forth about a specific wet type of toner in Japanese Patent Kokai Publication No. Sho. 58-2851. Typically, it may occur at 100° C. for about 2 to 5 minutes. It is understood that even with a general dry type of toner, toner fixation is achievable under the same conditions.

Furthermore, all portions of the charge carrier layer but the toner image are removed by etching, using the fixed toner image as a resist. This etching may be achieved by removing all portions of the charge carrier layer except the toner image with solvents in which the charge carrier layer dissolves; or removing all portions of the charge carrier layer, which are not covered with the toner, by calcination with plasma calcination equipment, etc. Alternatively, a photo-decomposable type of resin, for instance, a positive type of photoresist may be used as a charge carrier layer material. Then, the charge carrier layer is irradiated with allover active light (e.g. ultravioletet rays), using the toner image as a light-shielding image, followed by development where all portions of the charge carrier layer, which are not covered with the toner, are removed.

After all portions of the charge carrier layer but the toner image have been etched out in this manner, the electrode 7 is exposed to view. If required, such post-treatments as etching and rubberizing may be performed.

EXAMPLE 1

A 0.3-mm thick aluminium sheet was grained on its surface by ball polishing, followed by washing of that surface with the following plane regulating liquid and water.

| | |
|---|---|
| Phosphoric acid | 16 cc |
| Water | 1,000 cc |

Further, the aluminium sheet was made hydrophilic with the following treating solution, washed with water and dried.

| | |
|---|---|
| Aluminium bichromate | 1350 g |
| Water | 20 liters |
| 48% hydrofluoric acid | 160 cc |

Then, this aluminium sheet was rotary coated thereon with a 5% solution of an acrylonitrile/butadiene/acrylic acid polymer in toluene to a dry coverage of 3 μm. After that, the resulting film was dried in a 1000° C. oven for 30 minutes to obtain a plate.

On the other hand, a 500-angstrom thick ITO film was sputtered on a 3 -mm thick glass sheet to obtain an transparent electrode, which was found to have a planar resistance of 1,000 Ω/□.

On that was sputtered SiO2 at a thickness of 1,000 angstroms to form a charge blocking layer.

Furthermore, a 30-μm thick, a-Se layer was formed as a charge transporting layer by similar vacuum deposition to obtain a photosensitive material.

Then, this photosensitive plate was pressed onto the above-described plate with a local gap between them through a 9-μm thick polyester film. This gap was found to be 12 μm. Subsequently, a half tone or screen positive film of 150 lines per inch was brought into close contact with the photosensitive material. A voltage of +800 V was applied to the electrode of the photosensitive plate, while the aluminium plate was earthed.

The photosensitive plate was irradiated with substantially parallel light emanating from a tungsten lamp having a color temperature of 4,000° K. at an illuminance of about 50 luxes, as measured thereon. After switched on for 0.1 second, the plate was removed.

On that plate there was formed an electrostatic latent image of +170 V, which was in turn subjected to reversal development with the wet type of toner set forth in Japanese Patent Kokai Publication No. Sho. 58-2851. After the light was drying, the resulting image was fixed for 5 minutes in an oven of 100° C.

Furthermore, etching was carried out with a 5% aqueous solution of sodium carbonate, followed by water washing and drying, thereby giving a planographic printing plate.

As a result of offset printing with an offset proof press in an additional feeding of dampening water, it was confirmed that 3 to 96% dots of 150 lines per inch were printed.

Example 2

A printing plate prepared by following the procedures of Ex. 1 was mounted on a web offset printing press to obtain 100,000 prints. The printing plate turned out to be not damaged.

It is understood that while the production of one printing plate has been described, it would go without saying that a combination of four printing plates for Y, M, C and K must be prepared for color printing by similar steps as mentioned above.

The page make-up system using charge carrier media according to this invention will now be explained in greater detail. For a better understanding of that system, reference will first be made to the charge carrier medium used with said page make-up system, how to expose the charge carrier medium to light with the application of voltage and how to read the potential of an electrostatic latent image formed on the charge carrier medium.

Referring to FIGS. 3*a*–3*d*, these provide views for illustrating how to record images with the charge carrier medium, wherein reference numeral 21 stands for a charge carrier medium, 22 a photosensitive material and E a power source.

The charge carrier medium 21, for instance, is constructed by forming a 1,000-angstrom thick Al film on an insulating layer support 21*c* comprising a 1-mm thick glass by vapor deposition to form an electrode 21*b* and providing a 10-μm thick insulating layer 21*a* on the electrode 21*b*. The photosensitive material 22 is constructed from a support 22*a*, an electrode 22*b* and a photoconductive layer 22*c*, as is the case with the photosensitive material 1*a* shown in FIG. 1. For instance, a support 22*a* comprising a 1-mm thick glass may be provided thereon with a 1,000-angstrom thick, transparent electrode of ITO, and an about 10-μm thick photoconductive layer 22*c* may then be formed on that electrode.

Figure 3:
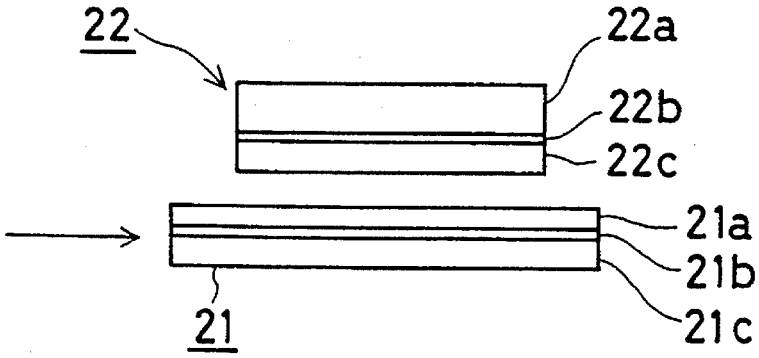
FIGS. 3*a*–3*d* are sectional views for illustrating how to record images with charge carrier media.
Figure 3:
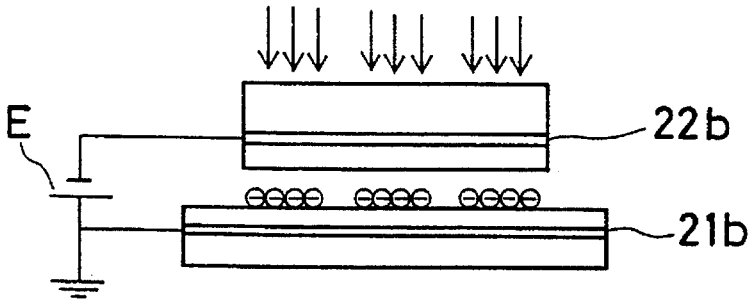
Figure 3:
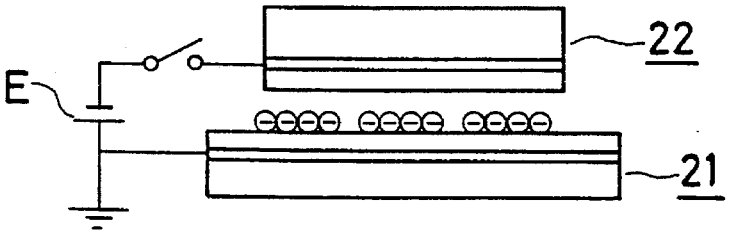
Figure 3:
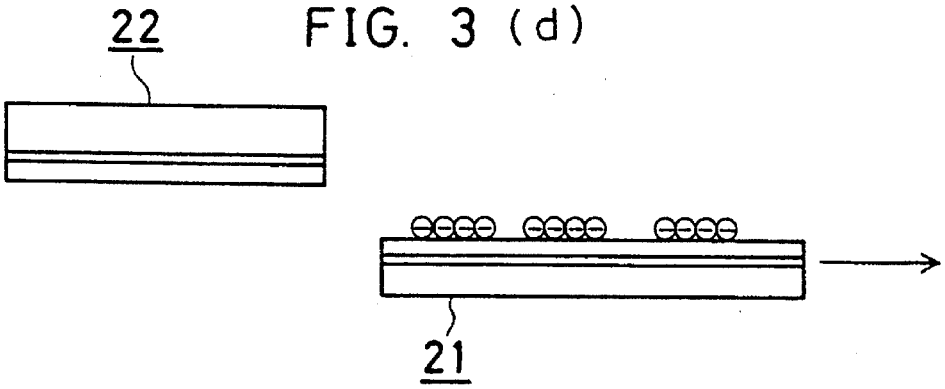

Referring again to FIG. 3*a*–3*d*, there is shown an embodiment wherein the charge carrier medium 21 is exposed to light through the photosensitive material 11. As shown in FIG. 3*a*, the charge carrier medium 21 is first spaced away from the photosensitive material 22 with a gap of about 10 μm between them. Then, the power source E applies a given voltage between the electrode 22*b* of the photosensitive material and the electrode 21*b* of the charge carrier medium, as shown in FIG. 3*b*. In the dark, there will be no change between both the electrode, due to the photoconductive layer 22*c* being a high resistance body. When light is incident on the photosensitive material 22, however, a portion of the photoconductive layer 22*c*, on which the light strikes, is made so electrically conductive that discharge takes place between it and the insulating layer 21*a*, causing accumulation of charges on the insulating layer 21*a*. This is exposure.

After the completion of exposure, the power source E is disconnected, as shown in FIG. 3*c*. Then, the charge carrier medium 21 is removed, as shown in FIG. 3*d*, thereby completing the formation of an electrostatic latent image.

It is noted that the photosensitive material 22 and charge carrier medium 21 may be either located in a non-contact fashion, shown in FIGS. 3*a*–3*d*, or arranged in a contact manner. When they are located in contact with each other, positive or negative charges are injected from the electrode 22*b* of the photosensitive material into the exposed region of the photoconductive layer 22*c*. These charges then pass through the photoconductive layer 22*c* under the attracting action of the electrode 21*b* and reaches the surface of the insulating layer 21 where charge transfer stops, thereby accumulating charges on that site. Subsequent separation of the charge carrier medium 21 from the photosensitive material 22 allows separation of the insulating layer 21*a* with charges remaining accumulated thereon.

This type of recording, when applied to planar analog recording, gives resolving power as high as does silver salt photographic techniques. The surface charges accumulated on the insulating layer 21*a*, which are exposed to an air atmosphere, can be stored without discharge over extended periods of time regardless of whether that layer is placed in the dark or in the light, since air can serve as a good insulator.

How long the charges are retained on the insulating layer 21*a* is determined depending upon ambient conditions and the insulator's nature, and is affected as well by not only air's insulating properties but also the insulator's capability to pick up charges. In the present disclosure, the "charges" have been described as surface charges. However, it is noted that in some cases charges may build up only on the surface of an insulator; in some cases charges may penetrate through an insulator via its surface with the electrons or holes being trapped in the structure of that material. Thus, the charges can be stored over extended periods of time. In order to prevent discharge, etc. due to physical damage of the charge carrier medium or in high humidity conditions, the insulating layer 21*a* may be covered on its surface with an insulating film, etc. for more stable storage.

Figure 4A:
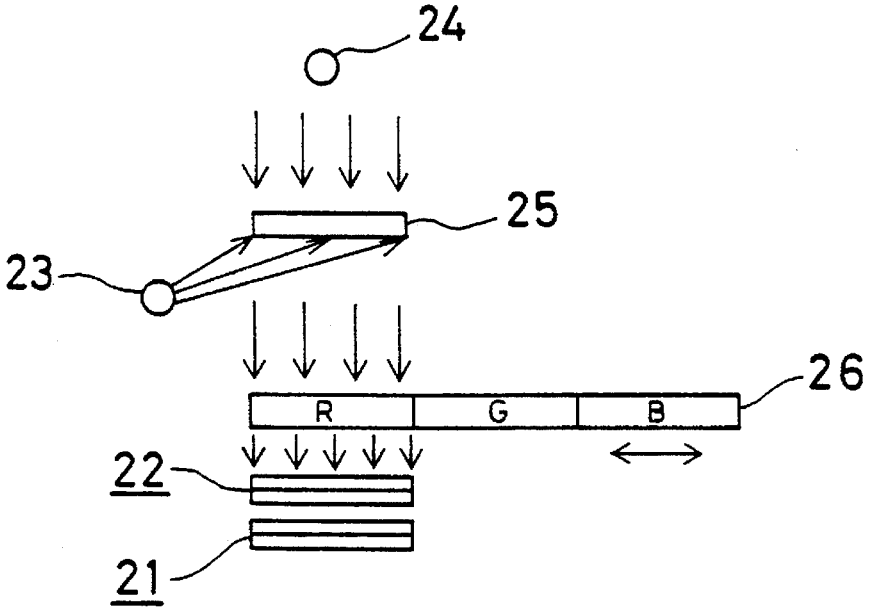
FIGS. 4*a*–4*b* are sectional views for illustrating how to record color images with charge carrier media.
Figure 4B:
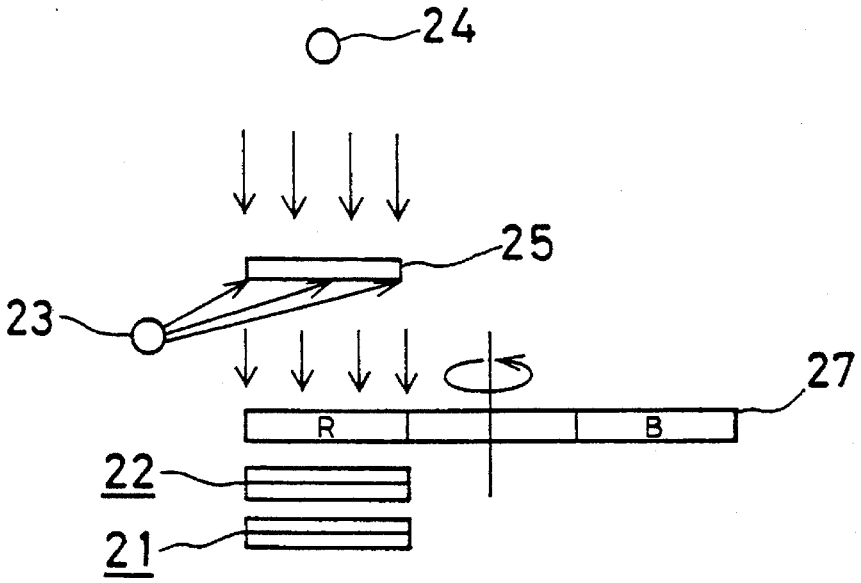

Referring now to FIGS. 4*a* and 4*b*, how to record color image information will be explained.

Referring first to FIG. 4*a*, an original 25 is irradiated with light from alight source 23 or 24, and the resulting transmitting or reflected light strikes upon the surface of a photosensitive material 22 through a color filter 26 for recording on a charge carrier medium 21. The color filter 26 comprises three red (R), green (G) and blue (B) elements, and is designed to move horizontally for selection of R, G and B. A set of three charge carrier media are used to record one piece of color image information.

Referring then to FIG. 4*b*, there is shown another embodiment of color image information recording, which is similar to that of FIG. 4*a* with the exception that a rotary type of color filter 27 is used for selection of R, G and B.

Several examples of how to read the potential of the thus recorded electrostatic latent image will now be explained with reference to FIG. 5*a*–5*k*.

Figure 5A:
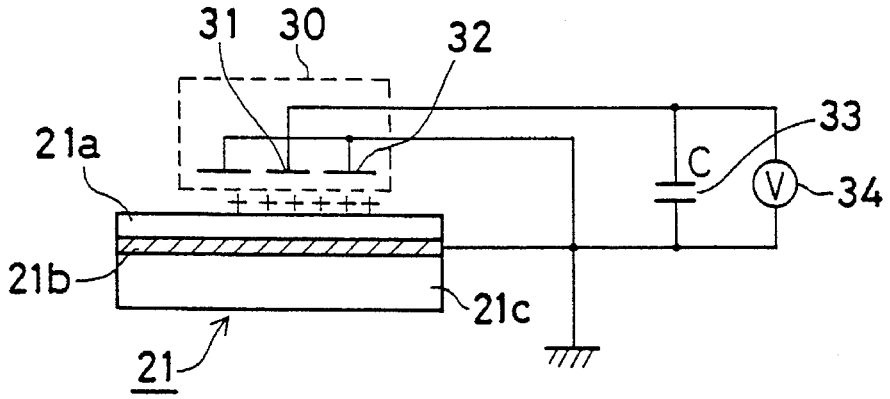
FIGS. 5*a*–5*k* are sectional views for illustrating how to read electrostatic latent images formed on charge carrier media.

One example of how to read potential is illustrated in FIG. 5*a* wherein the same parts as in FIG. 3*a* are indicated by the same reference numerals. In FIG. 5*a*, reference numeral 30 stands for a potential reader section, 31 a detection electrode, 32 a guard electrode, 33 a capacitor and 34 a voltmeter.

As the potential reader 31 is located in opposition to the charge-accumulating surface of a charge carrier medium 21, the detection electrode 31 receives an electric field defined by the charges accumulated on the insulating layer 21*a* of the medium 21, generating on its surface induction charges in an amount equal to that of the charges on the medium 21. Since the capacitor 33 is charged with charges of polarity opposite to that of such induction charges in the same amount, there is a potential difference corresponding to the accumulated charges across the electrode of the capacitor 33, which is in turn read on the voltmeter 34, thereby. determining the potential of the charge carrier medium 21. Then, an electrostatic latent image can be produced in the form of electrical signals by scanning the surface of the charge carrier medium 21 with the potential reader 31. It is noted that only with the detection electrode 31, there is a drop of resolving power under the action of an electric field (an electric line of force) defined over a range wider than the region of the charge carrier medium 21 opposite to the detection electrode 31. According to this arrangement, since the electric line of force acts vertically to the surface, it is possible to read the potential of a region having an area nearly equal to that of the detection electrode 32. Since the accuracy and resolving power of potential reading vary largely depending upon the geometry and size of the detection and guard electrodes 31 and 32 as well as the space between them and the charge carrier medium 22, it is essentially required to design them while taking into account the optimum conditions to meet the performance demanded.

Figure 5B:
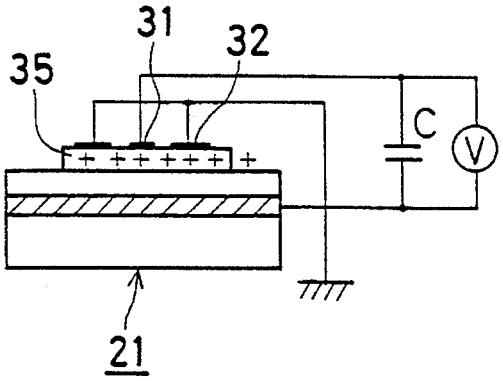

FIG. 5*b* illustrates another system to read potential, which is similar to that illustrated in FIG. 5*a*, provided that potential is detected through an insulating protective film 35 on which detection and guard electrodes 31 and 32 are mounted. According to this system that is designed to come in contact with a charge carrier medium 21 for the detection of potential, it is possible to keep constant the space between the detection electrode 31 and the charge carrier medium 21.

Figure 5C:
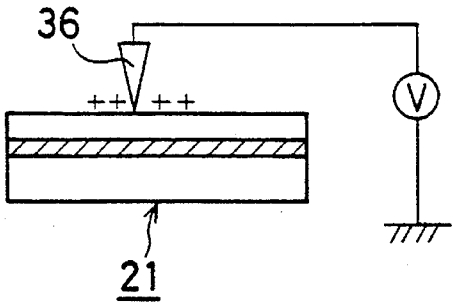

FIG. 5*c* is a view showing still other system of how to read potential, wherein a pin type of electrode 36 is brought in direction contact with a charge carrier medium 21 to detect the potential of the site of contact. With this system, it is possible to obtain high resolving power due to reductions in the area to be detected. Higher reading rates are also achievable by providing a plurality of the pin type of electrodes 36.

The above-described systems are all of the D.C. amplification type designed to detect D.C. signals in contact or non-contact relation. In what follows, an A.C. amplification type of system will be explained.

Figure 5D:
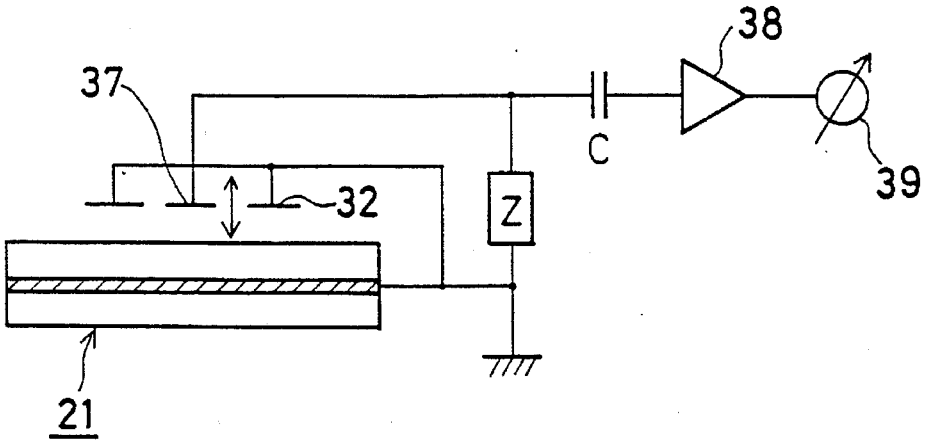

FIG. 5*d* is an illustration of a vibration electrode type of potential reading system, wherein 37 is a detection electrode, 38 an amplifier and 39 a meter.

The detection electrode 37 vibrates and is driven such that as time goes by, it displaces with respect to the charged surface of a charge carrier medium 21. As a result, potential across the detection electrode 37 varies with time at an amplitude corresponding to the electrostatic potential of the charged surface. This potential change with time is then obtained in the form of a voltage change appearing across an impedance Z, and the a.c. component is in turn amplified by the amplifier 38 through a capacitor C to measure the electrostatic potential of the charged surface in terms of readings on the meter 39.

Figure 5E:
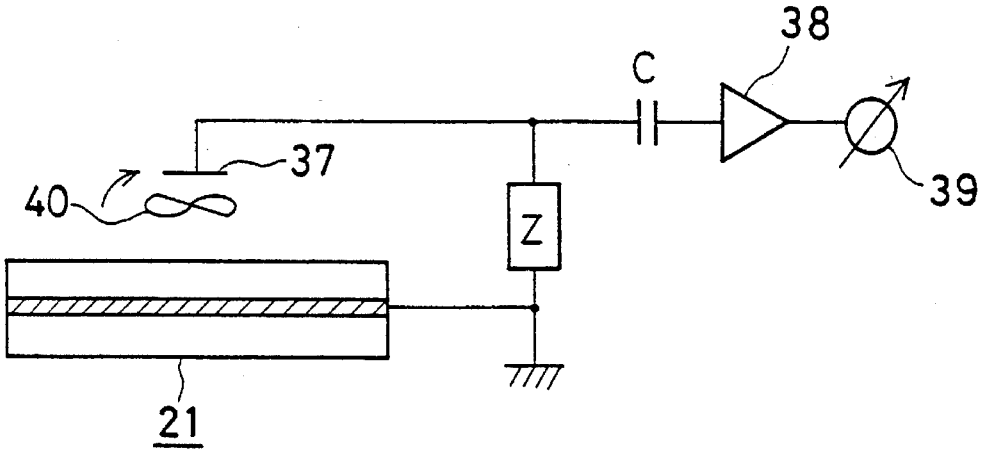

FIG. 5*e* shows an example of a rotary detector, wherein a rotary blade is indicated at 40.

Between a detection electrode 37 and the charged surface of a charge carrier medium 21, there is an electrically conductive rotary blade 40 driven for rotation by driving means, not illustrated. In consequence, the detection electrode 37 is periodically and electrically shielded relative to the charge carrier medium 21. Potential signals varying periodically at an amplitude corresponding to the electrostatic potential of the charged surface are then detected by the detection electrode ST, and the A.C. component is in turn amplified by an amplifier 38 for reading.

Figure 5F:
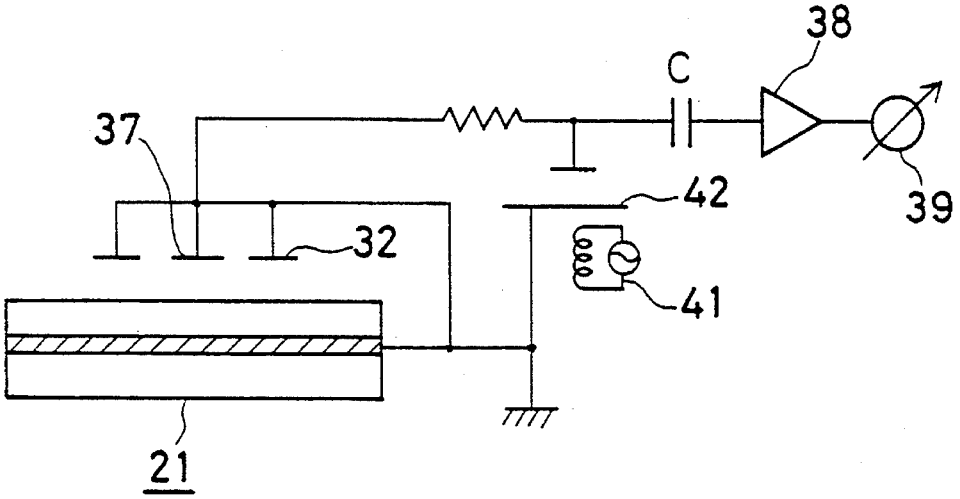

FIG. 5*f* is an illustration of a vibrating capacitance-reed detector, wherein reference numerals 41 and 42 stand for a driving circuit and a vibrating reed, respectively.

The vibrating reed 42 of one electrode forming a capacitor is vibrated by the driving circuit 41 to change the capacitor's capacity. In consequence, D.C. potential signals detected by a detector electrode 37 are modulated, and the A.C. component is then amplified and detected. With this detector designed to convert direct currents to alternating currents. It is possible to measure potential with high sensitivity and good stability.

Figure 5G:
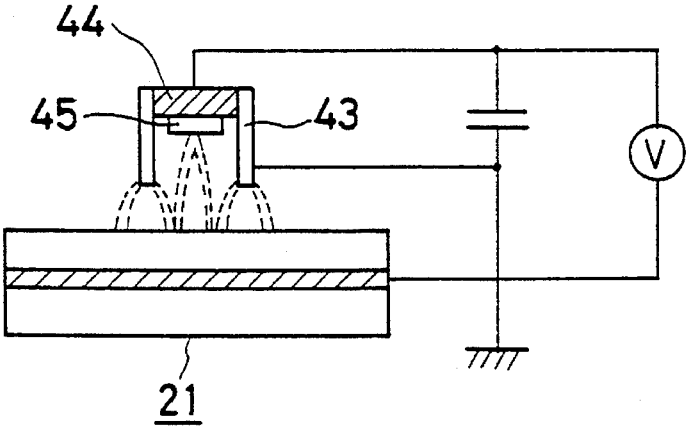

FIG. 5*g* shows an example of a collector type of detector, in which reference numeral 43 indicates a grounded type of metallic cylinder, 44 an insulator and 45 a collector.

The collector 45 contains a radioactive substance which emits α-rays. The air in the metallic cylinder is thus ionized to form positive and negative ion pairs. Under natural conditions, these ions tend to disappear by recombination and diffusion until equilibrium is reached. In the presence of an electric field, however, they collide repeatedly with air molecules through thermal motion and migrate statistically toward the electrical field, thus playing a role of carrying charges. That is, for the reason that the air is made electrically conductive by ions, an equivalent electrical resistance path is taken as existing between the collector 45 and a surrounding object. Consequently, for a stationary state the following equation holds;

$$V_2=R_2V_1/(R_1+R_2)$$

wherein:

$R_1$ is the resistance between the charged body and the collector 45, $R_2$ is the resistance between the collector 45 and the grounded metallic cylinder 43, $V_1$ is the potential of the charged body, and $V_2$ is the potential of the collector 45. In this connection, it is understood that the resistance between the charged surface of a charge carrier medium 21 and the grounded metallic cylinder 43 is defined as $R_0$. Thus, it is possible to find the potential of the charge carrier medium 21 by reading the potential of the collector 45.

Figure 5H:
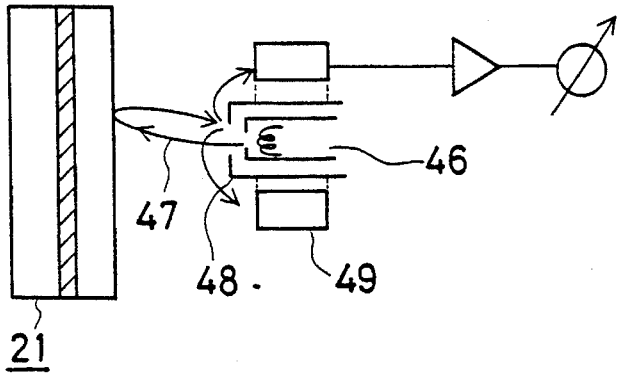

FIG. 5*h* is an illustration of an example of an electron beam type of potential reader system, in which reference numeral 46 denotes an electron gun, 47 electron beams, 48 a first diode and 49 a secondary electron amplifier section.

Electrons leaving the electron gun 46 are deflected by an electrostatic or electromagnetic deflector, not shown, and scan the charged surface. Some of the scanning electron beams join to the charges of the charged surface into a charging current, and so the potential of the charged surface drops to equilibrium potential, correspondingly. Another portion of the beams is modulated and fed back toward the electron gun 46. In the meantime, they collide with the first diode 48. The resultant secondary electrons are amplified by the secondary electron amplifier 49 and obtained from the anode in the form of a signal output. As the return electron beams, reflected or secondary electrons may be used.

With the electron beam type of potential reader system, uniform charges are formed on the medium after scanning, but a current corresponding to the latent image is detected during scanning. When the latent image carries negative charges, accumulation of charges by electrons is reduced in a region (unexposed) which has carried much charges, so that the resultant charging current is limited. However, a maximum charging current occurs, for instance, in charge-free regions. Positive charges, on the contrary, define a negative type.

Figure 5I:
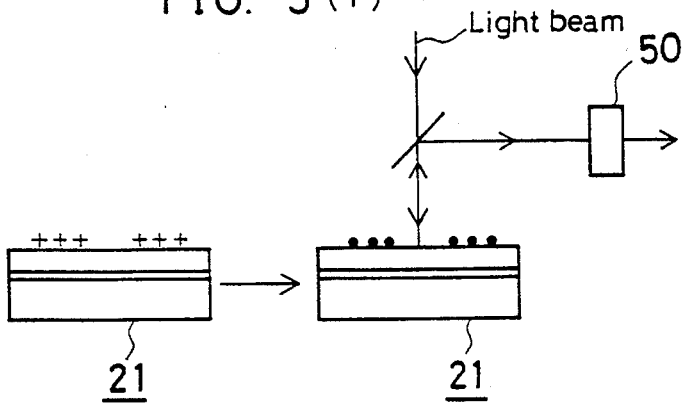

FIG. 5*i* is an illustration of a further example of the potential reader system. A charge carrier medium 21, on which an electrostatic latent image has been formed, is toner-developed. The colored surface is then irradiated with light beams for scanning. The reflected light is converted to electrical signals by a photoelectric converter 50. With this system, high resolving power is attainable by reducing the diameters of light beams, and detection of electrostatic potential can be easily performed as well in an optical fashion.

Figure 5J:
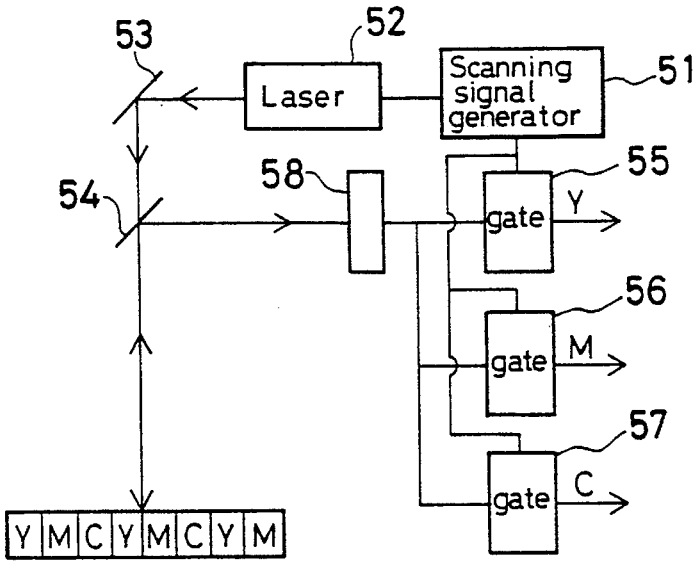

FIG. 5*j* shows a still further example of the potential reader system. Color-separated images R, G and B formed by such a fine color filter as will be described later are toner-imaged. Then, the colored surfaces are irradiated with light beams to convert the reflected light to signals Y, M and C. In FIG. 5*j*, reference numeral 51 denotes a scanning signal generator, 52 a laser, 53 a reflector, 54 a half mirror, 58 a photoelectric converter and 55, 58 and 57 gate circuits.

With scanning signals from the generator 51, the colored surfaces are irradiated with laser beams from the laser 52 through the reflector 53 and half mirror 54 for scanning. The light reflected from the colored surfaces is then fed into the photoelectric converter 58 through the half mirror 54 to convert it to electrical signals. If the gate circuits 55, 56 and 57 are controlled for opening or closing synchronously with the signals from the signal generator 51, then they are controlled for opening or closing synchronously with the pattern of the fine filter. Thus, it is possible to obtain signals Y, M and C, even when they have not previously been colored.

It is noted that even when a color image is split into three planes as will be described later, signals Y, M and C are quite similarly obtainable, again, without having previously colored them.

In the systems shown in FIGS. 5*i* and 5*j*, it is required for the toner-developed images to have the γ-characteristic corresponding to the quantity of electrification of the electrostatic latent image. For this reason, it is not required to provide a threshold value with respect to an analog change in the quantity of electrification. Given the corresponding relationship, it is then possible to correct γ by electrical processing, even when the γ-characteristic is not in keeping with the quantity of electrification.

Figure 5K:
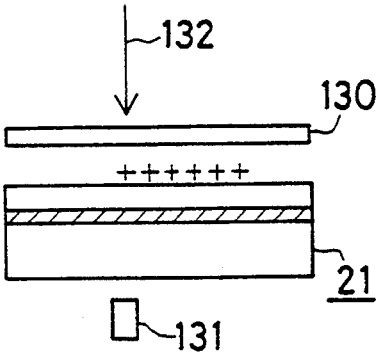

FIG. 5*k* is an illustration of a still further example of potential reading, wherein an electrical line of force generated by electrostatic charges acts on an electro-optical material 130, and the resulting change is read by an optical sensor 131 through light 132.

The electro-optical material 130 used, for instance, may include $LiNbO_3$ and liquid crystals. The light 132 may be deflected, if required, and the optical sensor 131 may contain a deflector, if desired.

In the embodiment shown in FIG. 5*k*, a charge carrier medium 21 is transparent. However, it goes without saying that this system may be used with such an optical system as shown in FIGS. 5*i* and 5*k*, thereby detecting reflected light. While the light 132 and optical sensor 131 are kept stationary, scanning may be effected with the charge carrier medium 21. On the contrary, scanning may be performed with the light 132 and optical sensor 131. In addition, such an area sensor as a CCD may be used as the optical sensor 131, thereby focusing an image on the area sensor through a lens.

Color filters used to form color images will now be explained in greater detail with reference to FIGS. 6 to 10.

Figure 6:
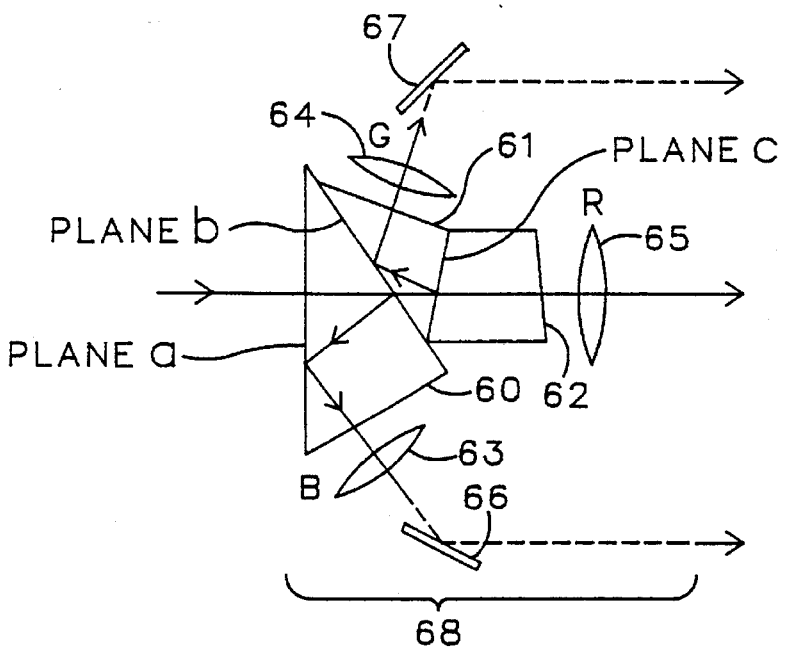
FIG. 6 is a view showing the construction of a color separating, optical system.

Referring first to FIG. 6, there is shown a prismatically color-separating, optical system 68 in which reference numerals 60, 61 and 62 stand for prism blocks, 63, 64 and 65 filters and 66 and 67 reflectors.

The color-separating, optical system 68 is constructed from three prism blocks 60, 61 and 62. Optical information incident on a plane a of the prism block 60 is partly separated and reflected from a plane b, giving an optical component of color B through the filter 63. The rest of the optical information is incident on the prism block 61 and reaches a plane c from which it is partly separated and reflected. Another portion reaches directly the filter 65 from which optical components of colors G and R are obtained. The optical components of colors G and B may then be reflected from the reflectors 66 and 67, giving the R, G and B light components in the form of parallel light beams.

Figure 7A:
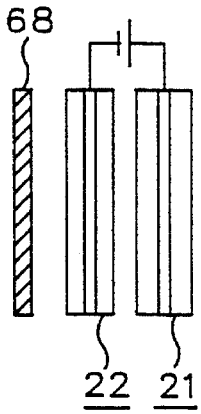
FIGS. 7*a*–7*c* are views for illustrating the formation of color, electrostatic latent images.
Figure 7B:
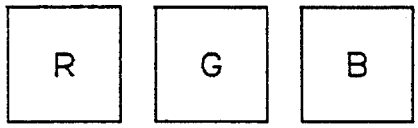
Figure 7C:
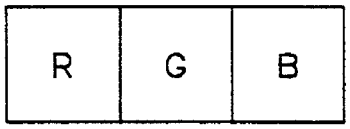

By disposing such a color-separating, optical system 68 as shown in FIG. 7 in front of a photosensitive material 22 for photographing as illustrated in FIG. 7*a*, one frame may be formed either by three sets of charge carrier media separated into R, G and B colors, as shown in FIG. 7*b*, or by a set of R, G and B images arranged on one plate, as illustrated in FIG. 7*c*.

Figure 8:
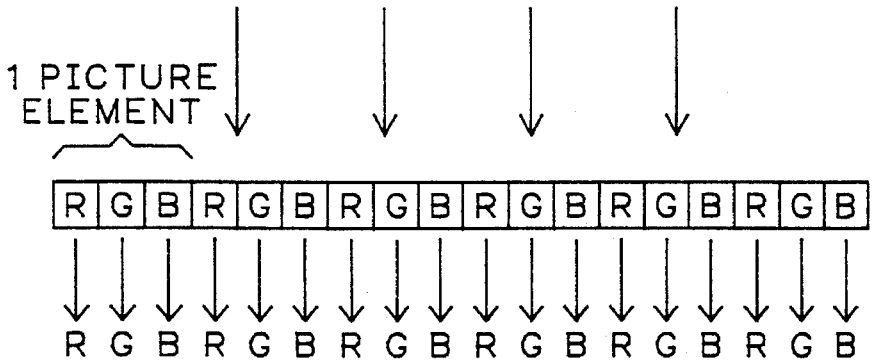
FIG. 8 is a view showing an example of the fine color filter.

FIG. 8 is an illustration of one fine color filter. For instance, this may be formed by exposing a resist-coated film to light through a mask pattern to form R, G and B striped patterns, which are then dyed in R, G and B; passing light components separated with the system of FIG. 6 through fine slits to obtain R, 6 and B interference fringes, which are then recorded in a hologram recording medium; or forming R, G and B striped patterns with electrostatic latent images, which are then toner-developed and transferred three times for color synthesis, thereby forming toner stripes. In this filter formed as mentioned just above, a set of R, G and B forms one picture element as fine as about 10 μm. If this filter is used as the color-separating, optical system 68 of FIGS. 7*a*–7*c*, it is then possible to form a color, electrostatic latent image. In this case, the filter may be spaced away from or made integral with the photosensitive material.

Figure 9:
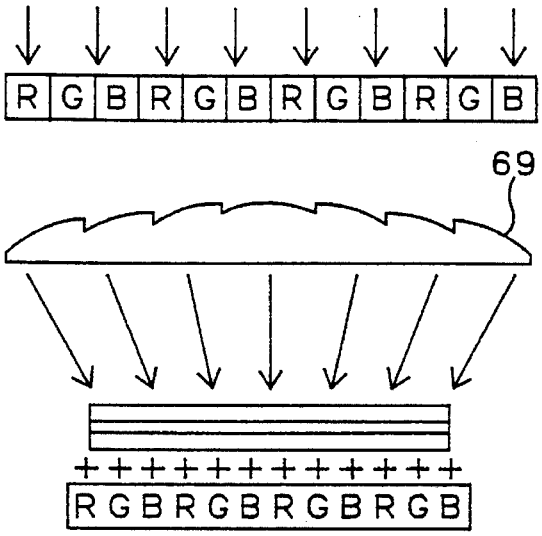
FIG. 9 is a view showing an example of the fine color filter used in combination with a Fresnel lens.

FIG. 9 is a view showing one example of the fine color filter combined with a Fresnel lens 69, in which R, G and B patterns may be reduced in size by the Fresnel lens for recording and lens designs may be made more compact and thinner than conventional lens ones.

Figure 10:
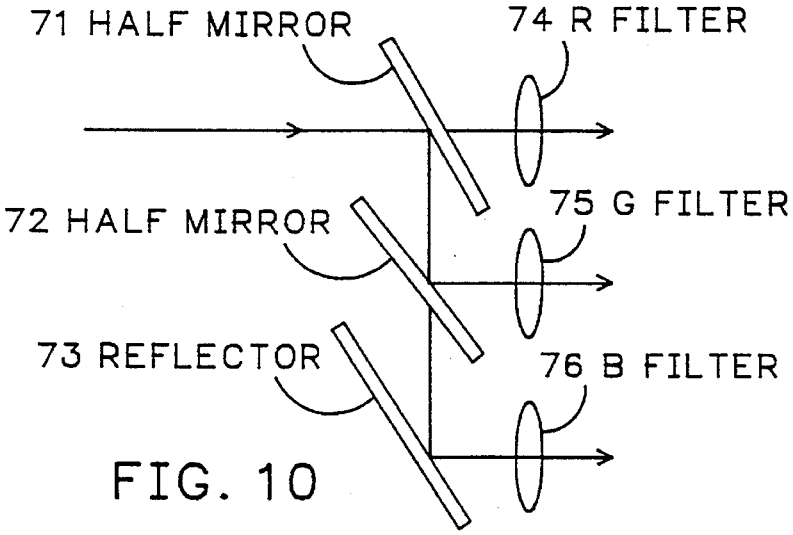
FIG. 10 is a view showing three plane-splitting when using a half mirror and a mirror in combination with R,G and B filters.

FIG. 10 is a view showing one example of three-plane splitting in which half mirrors are used in combination with R, G and B filters. Incident light is split into three portions through half mirrors 71 and 72 and a reflector 73, which are then allowed to pass through R, G and B filters 74, 75 and 76, respectively, giving R, G and B components of light in the form of parallel light beams.

The electrostatic latent images formed on the charge carrier medium may be erased by:

(1) Exposing the medium to light with the application of a voltage having polarity opposite to that applied for latent image formation, using the same exposure pattern as used for latent image formation or an exposure pattern reverse in brightness to that used for latent image formation;

(2) Exposing the medium to uniform light with the application of a voltage having the same polarity as or the reverse polarity to that of the voltage applied for latent image formation;

(3) Heating the medium by suitable heating means such as infrared ray, resistance, microwave or thermal head heating;

(4) Exposing the medium to ultraviolet rays using the same exposure pattern as that used for latent image formation;

(5) Uniformly exposing the medium to ultraviolet rays;

(6) Scanning the medium while an electrically conductive material is brought into contact therewith;

(7) Depositing moisture onto the medium's surface; and (8) Applying to the medium a voltage having the same or opposite polarity, while it is located in the vicinity of an electrode.

These techniques may be employed to erase the electrostatic latent images. When it is intended to erase the electrostatic latent images formed on a part of the charge carrier medium, however, this may be achieved by using any one of the above-described techniques while all portions but the region to be erased are masked.

One embodiment of the page make-up system using charge carrier mediums according to this invention will now be explained in greater detail.

Figure 11:
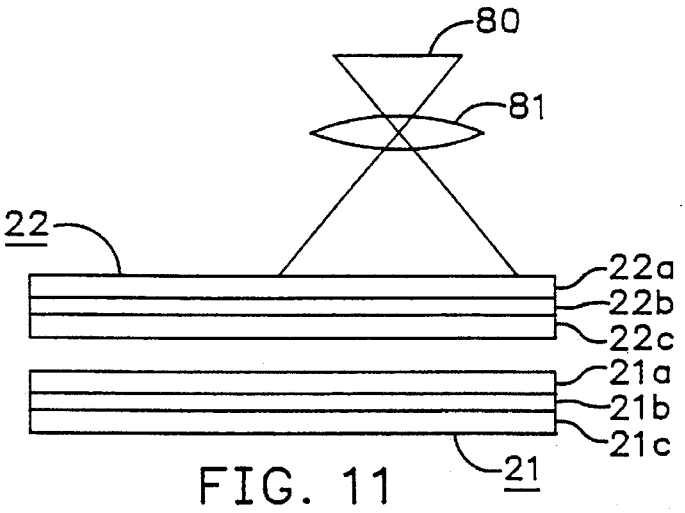
FIG. 11 is a view for illustrating exposure of an original image in the page make-up system using a charge carrier medium.

Prior to page make-up work, a charge carrier medium 21 and a photosensitive material 22 are provided. As illustrated in FIG. 11, the photosensitive material 22 is exposed to light through an original image 80 and a suitable lens system 81 at such a magnification as prescribed by an associated layout sheet, say, on a full-size scale in the instant example, whereby an electrostatic latent image corresponding to the original image 80 is formed on a given position of the charge carrier medium 21. If this cycle is repeated for all originals assigned to said layout sheet, it is then possible to effect page make-up for the originals used on said layout sheet. At this time, the sizes of the charge carrier medium 21 and photosensitive material 22 may be such that the original images can be exposed to light according to the prescribed size, say, the full size in this example. By reading the potential of the thus formed electrostatic latent image with any one of the above-described potential reading techniques, the full-size image data are processed in an image processor for density regulation, tone adjustment, trimming and other purposes. Finally, that data can be output through a color scanner on a film. In this regard, however, it is particularly preferable to use the charge carrier medium 21 and photosensitive material 22 that are of the same size as that of the layout sheet, because all the original images used on the associated page can be laid out by projection on the position prescribed on the associated layout sheet. It is understood that the projection of the original images may preferably be carried out in a range larger than the trimming range prescribed on the layout sheet. The projection of the original images on the position prescribed on the layout sheet at the prescribed magnification and in the prescribed direction may be achieved by using conventional equipment, e.g. an image projector.

It is essentially important to project the original images on the layout sheet on a full-size scale, i.e., the size prescribed on the layout sheet. As a matter of course, however, it is noted that in what size the original images are projected is a matter of choice. For instance, they may be projected on a scale reduced to a half the prescribed size; however, this offers various problems. In other words, the prescribed magnification may immediately be used if the original images are projected at full-size scale. Whenever they are projected on a reduced scale, however, it is required to fix the magnification at ½, and this is likely to give rise to an error in magnification setting. This is even so especially when exposure is again carried out after the once obtained electrostatic latent image has been erased. In the case of full-scale exposure, the image data may immediately be used not only for the image processing to be described later but also for exposure of an output film through a color scanner. In the case of exposure on a reduced scale, however, the image data must be enlarged for output to the film, and this does not only incur an extra time for image processing but also cause cost rises due to the need of using hardware for enlargement processing. Although such time consuming work and cost rises may be negligible, it would be clear that the image exposed on a full-size scale outclasses the image exposed on an enlarged scale. Full-size exposure is also more advantageous in reading the potential of the charge carrier medium. This is because, since exposure on a reduced scale must eventually be followed by enlargement processing, the density of the picture elements read must be made higher than that in the case of full-scale exposure, with attendant increases in the cost of the reading head.

Figure 12:
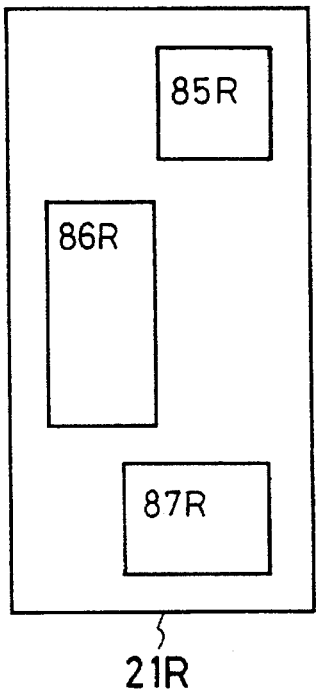
FIGS. 12*a*–12*c* are views showing an example wherein R, G and B electrostatic latent images are formed on separate charge carrier media.
Figure 12:
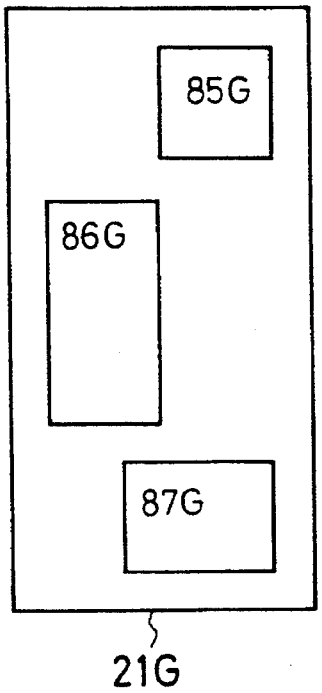
Figure 12:
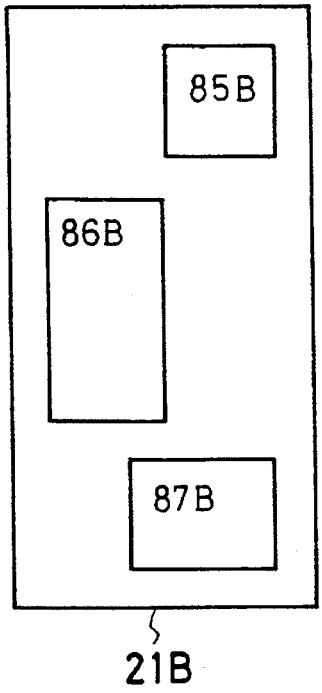
Figure 13:
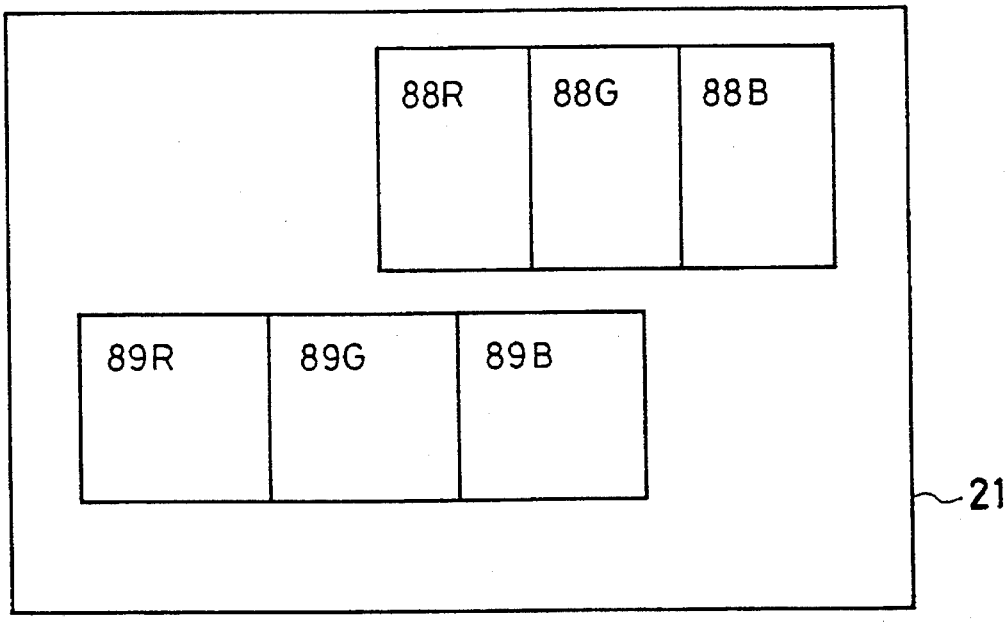
FIG. 13 is a view showing an example wherein R, G and B electrostatic latent images are formed on one charge carrier medium.
Figure 17:
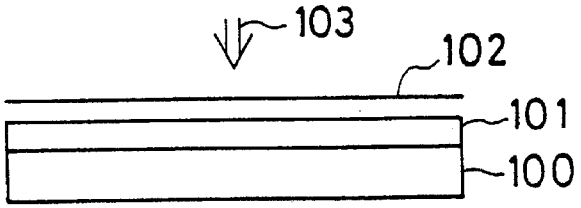
FIG. 17 (a) PRIOR ART
FIGS. 17*a*–17*b* are sectional views showing a first example of conventional processes for making printing plates.
Figure 17:
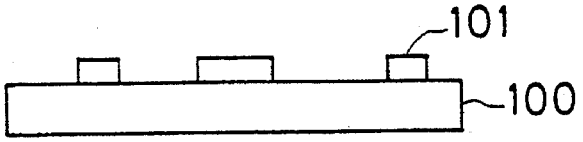
FIG. 17 (b) PRIOR ART
Figure 18:
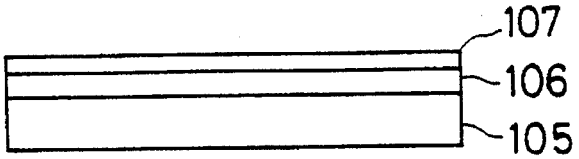
FIG. 18 PRIOR ART
FIG. 18 is a sectional view showing a second example of conventional processes for making printing plates.
Figure 19:
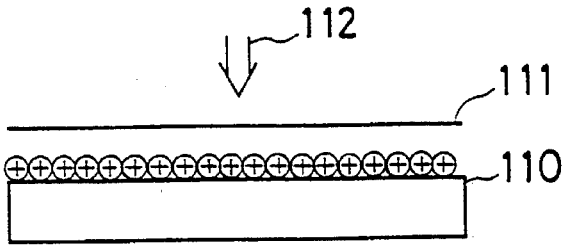
FIG. 19 (a) PRIOR ART
FIGS. 19*a*–19*c* are sectional views showing a third example of conventional processes for making printing plates.
Figure 19:
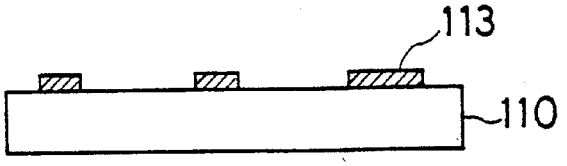
FIG. 19 (b) PRIOR ART
Figure 19:
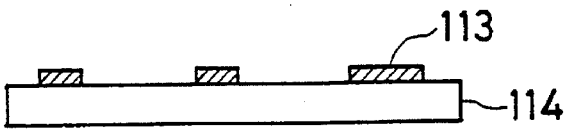
FIG. 19 (c) PRIOR ART
Figure 20:
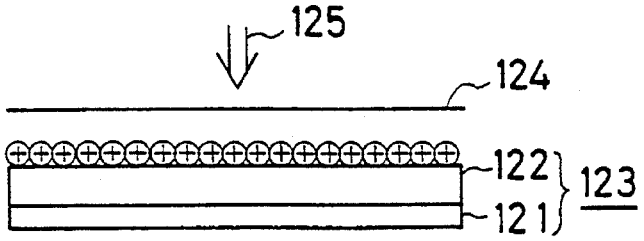
FIG. 20 (a) PRIOR ART
FIGS. 20*a*–20*c* are sectional views showing a fourth example of conventional processes for making printing plates.
Figure 20:
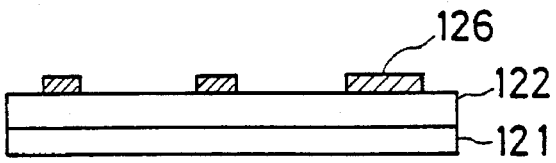
FIG. 20 (b) PRIOR ART
Figure 20:
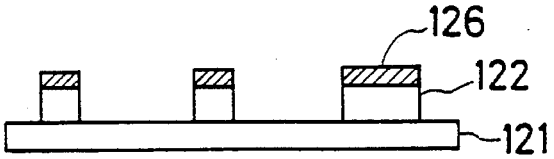
FIG. 20 (c) PRIOR ART

Then, the original image must be separated into three colors R, G and B. For this purpose, as shown in FIGS. 12*a*, 12*b* and 12*c*, the red, green and blue, electrostatic latent images may be formed on three charge carrier media $\mathbf{21}_R$, $\mathbf{21}_G$ and $\mathbf{21}_B$, respectively, with the procedure shown in FIG. 6 or 10. Alternatively, the striped color-filter may be used to form such electrostatic latent images with the procedure shown in FIG. 8. With the striped color-filter, the quantity of misalignment among the color-separated images matches the quantity of relative color mismatching with respect to the colors of the striped filter, thus depending upon the positional accuracy of the striped filter. This implies that if the striped filter is located in place, there will be no color mismatching in principle. With the procedure shown in FIGS. 12*a*–12*c*, on the other hand, mechanical registration must be effected with high accuracy.

Now consider spatially the procedure using the striped color-filter. If information is available with the filter of one color, it will be unavailable with the filters of other two colors. With the procedure shown in FIGS. 12*a*–12*c*, on the other hand, color-separated images of high resolution can be obtained.

In order to obtain sufficient resolution while taking full advantage of the excellent positional accuracy achieved by the striped color-filter method, the pitch of three-colored or R, G and B stripes may be made fine to the required resolution. For instance, one side of one picture defined by three colors R, G and B may be up to 50 μm in length, because the resolution capable of outputting a dot image of 175 lines per inch is said to be more than 500 lines per inch. Color character reading should be much higher in resolution than color image reading, and so should have a resolution of 1,200 to 2,400 lines per inch. For color character reading, therefore, the striped color-filter pitch may be determined such that picture elements of about 20 to 10 μm in size are obtainable.

With such procedures, electrostatic latent images of the original images can be formed on the prescribed position on a layout sheet according to the prescribed size. It is understood, however, that if the objective is only to form a full-scale electrostatic latent image irrespective of position, an array of R, G and B electrostatic latent images of one original image may be formed on one charge carrier medium 21 in side-by-side relation. It represents red, green and blue images of originals.

For exposure, only a given position on the charge carrier medium may be exposed to light through the individual originals. In this connection, it is noted that other regions should be protected against fog, etc. To this end, exposure may be effected, while said other regions are masked. Alternatively, a given voltage may be applied to only the region to be exposed in an arrangement wherein an electrode 22*b* of the photosensitive material and an electrode 22*b* of the charge carrier medium, both in striped forms, are designed to intersect each other at nearly right angles.

It is understood that when misalignment, etc. have occurred during exposure, the resulting electrostatic latent image is erased with any one of the above-described erasion techniques, after which re-registration is carried out, followed by exposure.

After the R, G and B electrostatic latent images corresponding to the original images assigned to the associated page have been formed as mentioned above, the potentials of said electrostatic latent images are read with any one of the potential reading systems shown in FIGS. 5*a*–5*k*, and are then fed to a suitable image processor in the form of electrical signals, where such image processings as trimming, density regulation or tone adjustment are done, if required. Finally, the output is fed to a color scanner for output to a film. FIG. 14 shows one system designed to this end.

In a reader 90, the electrostatic latent images recorded on a charge carrier medium 21 are read. More specifically, the electrostatic latent images recorded on the charge carrier medium 21 are read by a reading head 92, with any one of the above-described systems for reading electrostatic latent images. The analog data readings are fed through an amplifier 93 wherein they are amplified into an image processor 91. In this image processor 91. the R, G and B analog data fed out of the reader 90 are converted through a digital convertor 94 into digital data of given bits, followed by such processings as trimming and color conversion. In FIG. 14, trimming, color conversion and muddiness correction occur in that order. A trimmer 95 is used to extract only the range prescribed by the layout sheet from the images data of the respective originals. For instance, this is achieved by displaying the fed-in images on CRTs, etc. and specifying the range to be extracted. A color convertor 96 is provided to convert the R, G and B data into C, M, Y and K data. The C, M, Y and K data obtained through the color convertor 96 are then corrected for muddiness by a muddiness corrector 97, wherein they are converted into C', M', Y' and E' in consideration of ink's muddiness, thereby avoiding printed images' muddiness due to ink's muddiness. The data corrected for muddiness are then subjected to dot processing in a dot processor 98. Dot processing, for instance, may be achieved by varying the size of dots depending upon the density of images, as shown in FIGS. 15*a*–15*b*. FIG. 15*a* shows a highlight or white tone array of dots; FIG. 15*b* a gray or 50% tone array of dots; and FIG. 15*c* a black or shadow tone array of dots. Thus, dot processing is achieved by varying the size of dots depending upon the density of images but without varying the pitch of dots.

Dot formation, for instance, may be done by a procedure resorting to a dot generator, as shown in FIGS. 16*a*–16*c*. This procedure will now be explained schematically. When one dot is in such a state as shown in FIG. 16*a*, it is weighed, as illustrated. Let us assume the density level of an image corresponding to one dot is found at 8, as shown in FIG. 16*b*. Then, the weight value is compared with the image level of 8 to make black zones whose density level exceeds the weight value, as shown by hatched zones in FIG. 16*c*. It is thus possible to form dots of size corresponding to the density level.

The image data subjected to dot processing is exposed to light by an exposure unit 99 based on the results of dot processing, and then fed to a color scanner (not shown) wherein a film wound around an input drum is exposed to light.

It is noted that FIG. 14 shows only the flow of signal processing. In this regard, it is needless to say that the system may include a memory for storing digitally converted image data, image data obtained as a result of dot processing or the like, display means such as color CRTs, input units such as keyboards or a mouse, and so on.

While the present invention has been described primarily with reference to the page make-up system for color images, it is understood that the present invention is applicable to page make-up systems intended for monochromatic images and characters.

So far, electrical or computer-aided page make-up systems have been intended primarily for color purposes for the reasons that they are costly; it is very troublesome to handle color separating plates as much as color separations without causing color mismatching; and it is not impossible to do manual work for monochromatic purposes. In short, the cost performance of electronic page make-up systems is too low to be applied to monochromatic images.

According to this invention, by contrast, the cost performance of electronic page make-up systems applied to monochromatic images can be greatly improved, since it dispenses with the computing processing required for layout, which is attributable to a drop of cost performance.

INDUSTRIAL APPLICABILITY

The present printing plates using charge carrier media, method for making them and page make-up systems using charge carrier media have wide applications in the field of making printing plates and page make-up systems.

What is claimed is:

1. A printing plate using a charge carrier medium, characterized by including a printing area on an electrically conductive substrate, said printing area being constructed from a charge carrier layer and a toner layer, wherein the toner layer as well as the charge carrier layer have the outline of the printing area information.

* * * * *